US005950141A

United States Patent [19]

Yamamoto et al.

[11] Patent Number: 5,950,141

[45] Date of Patent: Sep. 7, 1999

[54] DOZING SYSTEM FOR BULLDOZER

[75] Inventors: Shigeru Yamamoto; Hidekazu Nagase; Hiroshi Itogawa; Nobuhisa Kamikawa, all of Osaka, Japan

[73] Assignee: Komatsu Ltd., Tokyo, Japan

[21] Appl. No.: 08/796,263

[22] Filed: Feb. 6, 1997

[30] Foreign Application Priority Data

Feb. 7, 1996 [JP] Japan ..... 8-046600
Feb. 7, 1996 [JP] Japan ..... 8-046760

[51] Int. Cl.[6] ..... G01M 17/00

[52] U.S. Cl. ..... 702/41; 702/42; 702/44; 701/50; 701/213

[58] Field of Search ..... 364/508, 505, 364/173, 506, 507, 509, 510, 511, 524, 550, 551.01, 561, 562, 567, 568, 579, 580, 803, 805, 528.1, 528.16, 528.17, 528.4, 528.36; 172/74.5, 2, 1, 6, 3, 9, 4; 701/50, 213; 414/699, 273; 37/348, 382, 414, 416, 413; 340/685, 686; 177/139–141, 165; 705/413, 414; 702/1, 2, 33, 36, 41, 44, 47, 50, 100, 101, 104, 105, 138, 140, 150, 151, 154, 173, 174, 175; 294/53.5

[56] References Cited

U.S. PATENT DOCUMENTS

| | | | |
|---|---|---|---|
| 4,282,933 | 8/1981 | Suganami et al. | 172/4.5 |
| 4,630,685 | 12/1986 | Huck, Jr. et al. | 172/7 |
| 4,995,468 | 2/1991 | Fukuda | 177/141 |
| 5,224,815 | 7/1993 | Abels et al. | 702/41 |
| 5,462,122 | 10/1995 | Yamamoto et al. | 172/2 |
| 5,462,125 | 10/1995 | Stratton et al. | 172/826 |
| 5,467,829 | 11/1995 | Barton et al. | 172/4.5 |
| 5,499,684 | 3/1996 | Stratton | 172/4.5 |
| 5,503,232 | 4/1996 | Matsushita et al. | 172/2 |
| 5,515,927 | 5/1996 | Matsushita et al. | 172/3 |
| 5,546,093 | 8/1996 | Gudat et al. | 37/414 |
| 5,620,053 | 4/1997 | Kamikawa et al. | 172/4 |
| 5,621,643 | 4/1997 | Nakagami et al. | 701/50 |
| 5,630,633 | 5/1997 | Dupre et al. | 294/53.5 |
| 5,659,470 | 8/1997 | Goska et al. | 701/50 |

FOREIGN PATENT DOCUMENTS

| | | |
|---|---|---|
| 55-036776 | 9/1980 | Japan . |
| 62-291337 | 12/1987 | Japan . |
| 1-163324 | 6/1989 | Japan . |
| 3-043523 | 2/1991 | Japan . |
| 5-106239 | 4/1993 | Japan . |
| 6-003886 | 2/1994 | Japan . |
| 7-011665 | 1/1995 | Japan . |
| 7-011666 | 1/1995 | Japan . |
| 7-026586 | 1/1995 | Japan . |
| 7-048855 | 2/1995 | Japan . |
| 7-048856 | 2/1995 | Japan . |
| 7-048857 | 2/1995 | Japan . |
| 7-054374 | 2/1995 | Japan . |
| 7-062683 | 3/1995 | Japan . |
| 7-252859 | 10/1995 | Japan . |
| 8-068070 | 3/1996 | Japan . |
| 8-199620 | 8/1996 | Japan . |
| 8-260506 | 10/1996 | Japan . |

*Primary Examiner*—Hal Dodge Wachsman
*Attorney, Agent, or Firm*—Sidley & Austin

[57] ABSTRACT

During dozing operation, the amount of earth (i.e., load factor) accumulated on the front face of a blade is automatically detected independently of the operator's perception and, based on the detection, the dozing operation is automatically shifted from digging to carrying. The load factor is calculated by obtaining a horizontal reaction force and a vertical reaction force exerted on the blade during digging and by calculating the ratio of the vertical reaction force to the horizontal reaction force. When the load factor reaches a specified value, the blade is automatically controlled to incline backward to hold the earth.

34 Claims, 18 Drawing Sheets

DOZING SYSTEM FOR BULLDOZER

TECHNICAL FIELD

The present invention relates to a dozing system for a bulldozer and more particularly to a technique for detecting the volume of earth (i.e., earthwork) accumulated on the front face of the blade of a bulldozer during a dozing operation by the blade and a technique for automatically adjusting the pitch action of the blade in response to the detected volume of earth.

BACKGROUND ART

In the dozing operation of a known bulldozer, the operator manually manipulates the blade to be raised, lowered, tilted or pitched in order to regulate the load on the blade caused by ground-working and earth moving while avoiding the traveling slip (shoe slip) of the vehicle body. During the operation, a shift, for example, from digging to carrying, is based on the volume of earth accumulated on the front face of the blade (i.e., earthwork) that has been estimated by the operator's perception from the shoe slip condition of the vehicle body or the soil spilt from the blade surface.

However, it is difficult for the operator to accurately estimate the blade's earthwork by his perception, particularly when the bulldozer has a large-sized blade and causes little shoe slip, so that a smooth shift from digging to carrying cannot be carried out with effective timing. In addition, not only does the operation involving estimation based on human perception cause great fatigue to an unskilled operator but also such estimation itself is very difficult.

The present invention has been made with the purpose of overcoming the above problem and one of the objects of the invention is therefore to provide a dozing system for a bulldozer that is capable of automatically detecting the volume of earth accumulated on the front face of the blade during a dozing operation without depending on the operator's perception.

Another object of the invention is to provide a dozing system capable of automatically switching from digging to carrying according to the automatic detection of the volume of earth accumulated on the face of the blade.

SUMMARY OF THE INVENTION

The first object can be achieved by a dozing system for a bulldozer according to the invention, the system comprising:

(a) horizontal reaction force detecting means for detecting a horizontal reaction force exerted on a blade during a digging operation by the blade;

(b) vertical reaction force detecting means for detecting a vertical reaction force exerted on the blade during a digging operation by the blade; and (c) load factor calculating means for calculating a load factor of the blade, in which earth is accumulated on its front face, based on the ratio of the vertical reaction force to the horizontal reaction force, the ratio being calculated upon receipt of the outputs of the horizontal reaction force detecting means and the vertical reaction force detecting means.

According to the invention, a horizontal reaction force and a vertical reaction force exerted on the blade during a digging operation by the blade are detected by the horizontal reaction force detecting means and the vertical reaction force detecting means respectively. From the horizontal and vertical reaction forces thus detected, the ratio of the vertical reaction force to the horizontal reaction force is calculated. A load factor of the blade, in which earth is accumulated on the front face thereof, is then calculated from the above ratio. With this load factor, the volume of earth (earthwork) on the front face of the blade can be accurately estimated. The value of earthwork thus obtained is utilized in informing a timing for a shift from digging to carrying, in informing a need for maintenance due to damage to the vehicle, in supervising earthwork, etc.

Preferably, the load factor calculating means calculates the load factor from the ratio of the vertical reaction force to the horizontal reaction force and from the pitch angle of the blade.

The dozing system of the invention may further comprise display means for displaying the value of the load factor calculated by the load factor calculating means. This easily gives the operator prompt information on the load factor, thereby contributing to an improvement in work efficiency.

The horizontal reaction force detecting means may be one of the following detectors.

1. A detector comprising an engine rotational speed sensor for detecting the rotational speed of the engine and a torque convertor output shaft rotational speed sensor for detecting the rotational speed of the output shaft of the torque convertor. In the above detector, a speed ratio is first obtained that is the ratio of the engine rotational speed, detected by the engine rotational speed sensor, and the torque convertor output shaft rotational speed, detected by the torque convertor output shaft rotational speed sensor. Then, a torque convertor output torque is obtained from the above speed ratio and the torque convertor characteristic of the torque convertor. The torque convertor output torque is then multiplied by a reduction ratio between the output shaft of the torque convertor and the sprockets for driving the crawler belts for traveling the vehicle body. With this calculation, the horizontal reaction force exerted on the blade can be detected.

2. A detector comprising an engine rotational speed sensor for detecting the rotational speed of the engine when the torque convertor with a lock-up mechanism is locked up or a direct transmission is employed. An engine torque is obtained from the engine rotational speed detected by the engine rotational speed sensor and the engine torque characteristic of the engine. Then, the engine torque is multiplied by a reduction ratio between the engine and the sprockets for driving the crawler belts for traveling the vehicle body. With this calculation, the horizontal reaction force exerted on the blade can be determined.

3. A detector comprising a bending stress sensor for detecting a bending stress exerted on the trunnions that are respectively the joints of straight frames for supporting the blade and the vehicle body. Based on the bending stress detected by the bending stress sensor, the horizontal reaction force exerted on the blade is determined.

4. A detector comprising a driving torque sensor for detecting the amount of driving torque of the sprockets for driving the crawler belts for traveling the vehicle body. Based on the amount of driving torque detected by the driving torque sensor, the horizontal reaction force exerted on the blade is determined.

The vertical reaction force detecting means may be one of the following detectors.

1. A detector comprising (i) a head hydraulic pressure sensor for detecting hydraulic pressures on the heads of the blade lift cylinders for lifting or lowering the blade, (ii) a bottom hydraulic pressure sensor for detecting hydraulic pressures on the bottoms of the blade lift cylinders, and (iii) a yoke angle sensor for detecting the inclination angle of yokes, each securing one end of each blade lift cylinder. In the detector, the pressing force of the blade lift cylinders is obtained from the respective hydraulic pressures detected by the head hydraulic pressure sensor and bottom hydraulic pressure sensor. The value of the pressing force is multiplied by the cosine of the inclination angle of the yokes with respect to a vertical axis that has been detected by the yoke angle sensor, whereby the vertical reaction force exerted on the blade can be determined.

2. A detector comprising (i) a head hydraulic pressure sensor for detecting hydraulic pressures on the heads of the blade lift cylinders for lifting and lowering the blade and (ii) a bottom hydraulic pressure sensor for detecting hydraulic pressures on the bottoms of the blade lift cylinders. The pressing force of the blade lift cylinders is obtained from the respective hydraulic pressures detected by the head hydraulic pressure sensor and the bottom hydraulic pressure sensor. The value of the pressing force is then multiplied by a constant, whereby the vertical reaction force exerted on the blade can be determined.

3. A detector comprising strain gauges attached to the cylinder rods of the blade lift cylinders for lifting and lowering the blade and a yoke angle sensor for detecting the inclination angle of yokes, each securing one end of each blade lift cylinder. From the axial force of the blade lift cylinders detected by the strain gauges, the pressing force of the blade lift cylinders is obtained. The value of the pressing force is multiplied by the cosine of the inclination angle of the yokes with respect to a vertical axis detected by the yoke angle sensor, whereby the vertical reaction force exerted on the blade can be determined.

4. A detector comprising strain gauges attached to the cylinder rods of the blade lift cylinders for lifting and lowering the blade. From the axial force of the blade lift cylinders detected by the strain gauges, the pressing force of the blade lift cylinders is obtained. The value of the pressing force is multiplied by a constant, whereby the vertical reaction force exerted on the blade can be determined.

The second object of the invention can be achieved by a dozing system for a bulldozer according to the invention, the system comprising:

(a) load factor calculating means for calculating a load factor of a blade in which earth is accumulated on its front face during a digging operation by the blade; and (b) blade controlling means for controlling the blade so as to incline backwardly to hold the earth, when the load factor calculated by the load factor calculating means reaches a specified value.

According to the invention, a load factor of the blade in which earth is accumulated on its front face is calculated by a load factor calculating means during a digging operation by the blade, and when the calculated load factor reaches a specified value, the blade controlling means allows the blade to incline backwardly so as to hold the earth. Upon completion of the desired digging operation in this way, the blade is automatically shifted from a digging position to a carrying position (i.e., pitch back position) so that the digging operation is switched to the carrying operation at an effective timing during the dozing operation without depending on the operator s perception. This can lead to an improvement in work efficiency and a labor saving in the dozing operation.

In the invention, the load factor calculating means detects a horizontal reaction force and a vertical reaction force exerted on the blade and calculates the ratio of the vertical reaction force to the horizontal reaction force. From this ratio and the pitch angle of the blade, the load factor calculating means preferably calculates a load factor. Alternatively, the load factor calculating means may obtain a load factor by measuring the height of earth accumulated on the front face of the blade with a distance sensor attached to the vehicle body of the bulldozer.

The dozing system of the invention may further comprise target pitch angle calculating means for calculating a target pitch angle, to be used for inclining the blade backwardly, from the load factor calculated by the load factor calculating means and from the pitch angle of the blade. The blade controlling means preferably controls the blade such that the pitch angle of the blade becomes equal to the target pitch angle calculated by the target pitch angle calculating means. With this arrangement, the backward inclination of the blade can be more accurately controlled. The dozing system of the invention may further comprise unloading position detecting means for detecting that the bulldozer has reached an earth unloading position. The blade controlling means preferably controls the blade such that the blade inclines forwardly to unload the carried earth in response to the output of the unloading position detecting means. This automates a series of blade controls for digging, carrying and earth unloading.

Further, the dozing system of the invention preferably comprises transmission controlling means for controlling a transmission so as to be placed in reverse drive when the unloading position detecting means detects that the bulldozer has reached the earth unloading position. The dozing system may further include digging start position detecting means for detecting that the bulldozer has reached a digging start position, and the transmission controlling means preferably controls the transmission so as to be placed in forward drive in response to the output of the digging start position detecting means. In the dozing system comprising such transmission controlling means, when the bulldozer reaches the earth unloading position such as the edge of a cliff, the blade unloads the carried earth by inclining forwardly and the speed range is then switched to reverse drive by the transmission so that the bulldozer is driven backwardly to the digging start position. When the bulldozer reaches the digging start position, the speed range is switched to forward drive by the transmission so that the bulldozer travels forwardly to the earth unloading position. In the course of a digging operation as the bulldozer is forwardly driven, if the load factor of the blade which carries earth at its front face reaches a specified value, the blade automatically inclines backwardly so that the blade is placed in the carrying position to hold earth. In this way, labor necessary for dozing desired lanes can be more reduced.

The unloading position detecting means may be one of the following means.

1. A means comprising at least one laser projector disposed on the ground and a light receiving sensor disposed on the bulldozer for receiving laser beams projected from the laser projector.

2. A means comprising at least one laser projecting and receiving device disposed on the ground and a reflector disposed on the bulldozer for reflecting laser beams projected from the laser projecting and receiving device in the same direction.

3. A means comprising an ultrasonic sonar disposed on the bulldozer for projecting ultrasonic waves ahead of the vehicle body to detect the presence of the ground.

4. A means comprising a load detector for estimating the amount of earth ahead of the blade from changes in the load exerted on the blade.

5. A means for detecting an earth unloading position by measuring the travel distance of a bulldozer from a digging start position during forward drive by integration of the outputs of an actual vehicle speed sensor.

6. A means for detecting an earth unloading position by GPS (Global Positioning System).

The digging start position detecting means may be one of the following means.

1. A means comprising at least one laser projector disposed on the ground and a light receiving sensor disposed on the bulldozer for receiving laser beams projected from the laser projector.

2. A means comprising at least one laser projecting and receiving device disposed on the ground and a reflector disposed on the bulldozer for reflecting laser beams projected from the laser projecting and receiving device in the same direction.

3. A means for detecting a digging start position by counting the number of revolutions of sprockets for driving crawler belts, starting from an earth unloading position during reverse drive of the bulldozer.

4. A means for detecting a digging start position by GPS.

The dozing system of the invention may further include (a) memory means for storing a digging start position and an earth unloading position, which are inputted by teaching by the operator, and for storing a digging/carrying switch position where the blade is inclined backwardly by the blade controlling means and (b) drive controlling means for performing blade control according to an output signal from the memory means such that when the bulldozer is found to be in the digging start position, the transmission is placed in forward drive; when the bulldozer is found to be in the earth unloading position, the blade is allowed to forwardly incline thereby unloading the carried earth and the transmission is placed in reverse drive; and when the bulldozer is found to be in the digging/carrying switch position, the blade is allowed to backwardly incline to hold the earth. The provision of the drive controlling means enables the dozing system to study a digging start position, earth unloading position, and digging/carrying switch position from manual driving by the operator so that a map which shows the relationship between the position of the bulldozer and the switching of drive mode tan be prepared to enable automatic driving of the bulldozer.

BRIEF DESCRIPTION OF DRAWINGS

FIG. 6(*b*) is a graph showing the change of pressing force exerted on the blade.

BEST MODE FOR CARRYING OUT THE INVENTION

Referring now to the accompanying drawings, a dozing system for a bulldozer embodying the invention will be described below.

Figure 1:
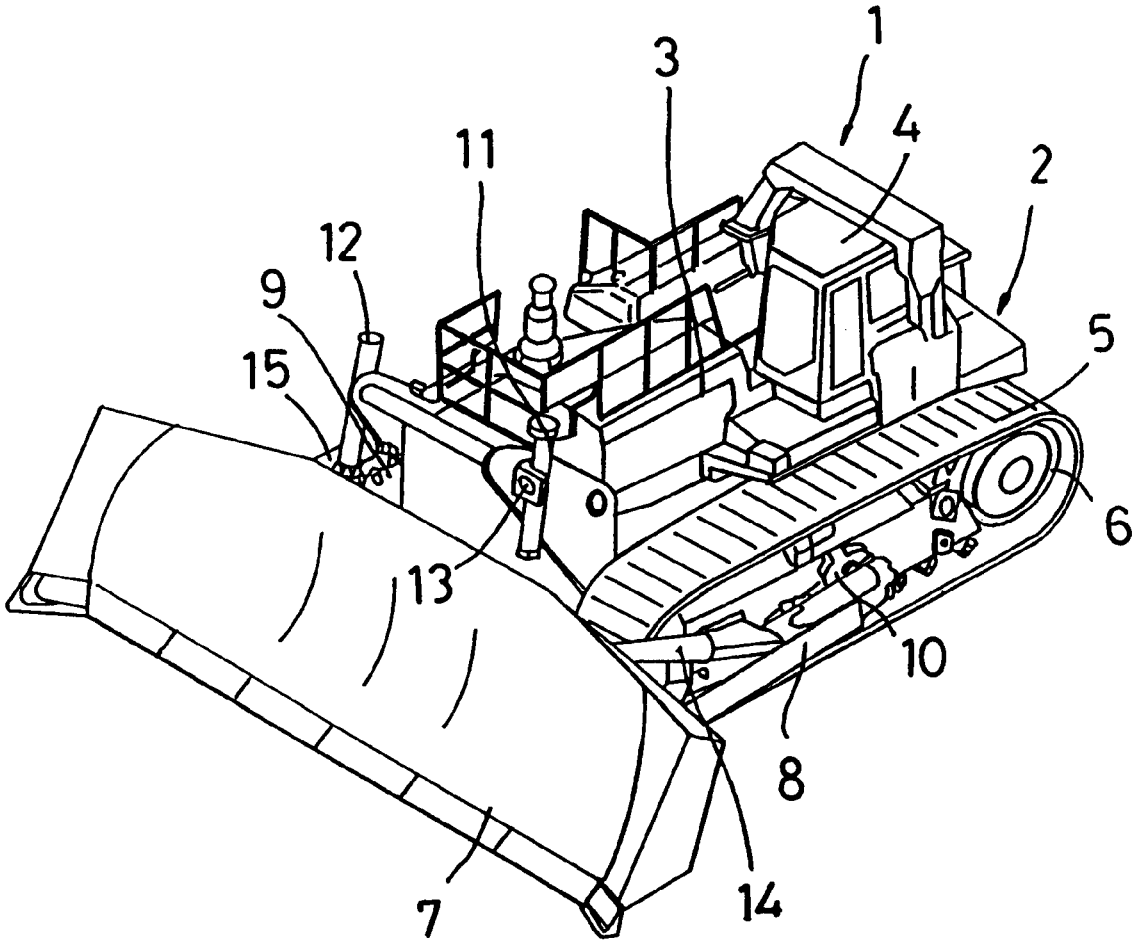
FIG. 1 is a perspective view of the external appearance of a bulldozer associated with one embodiment of the invention.
Figure 2:
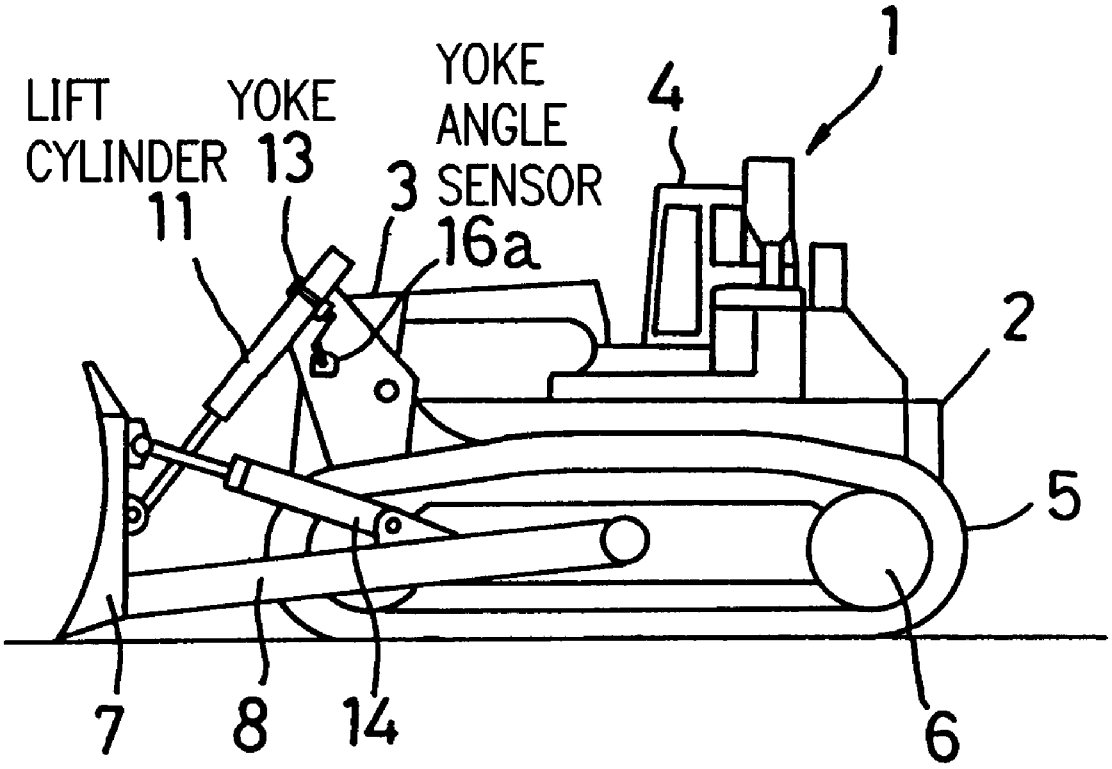
FIG. 2 is a side view of the bulldozer associated with the embodiment.

FIG. 1 shows a perspective view of the external appearance of a bulldozer associated with one embodiment of the invention and FIG. 2 shows its side view.

On a vehicle body 2 of a bulldozer 1 according to the embodiment of the invention, there are provided a bonnet 3 for housing an engine 20 (described later) and a cab 4 for the operator who drives the bulldozer 1. Disposed at the sides of the vehicle 2 are crawler belts 5 (the crawler belt on the right side is not shown in the drawing) for driving the vehicle body 2 to travel forwardly and reversely and to turn. The crawler belts 5 are respectively independently driven by power transmitted from the engine 20 with the aid of corresponding sprockets 6.

There is provided a blade 7 in front of the vehicle body 2. The blade 7 is supported by the leading ends of right and left straight frames 8, 9 the base ends of which are, in turn, pivotally supported at the vehicle body 2 through trunnions 10 (the right trunnion is not shown in the drawing) so that the blade 7 is supported so as to be raised or lowered in relation to the vehicle body 2. At the front sides of the vehicle body 2, there are provided a pair of blade lift cylinders 11, 12 laterally disposed for lifting or lowering the blade 7. The base ends of the blade lift cylinders 11, 12 are respectively supported by yokes 13 that are rotatably mounted on the vehicle body 2 while other ends of them are pivotally supported on the back face of the blade 7. For controlling the blade to be placed in a digging position, a pitch forward position or a pitch back position (these positions are to be described later), blade pitch cylinders 14, 15 are provided between the blade 7 and the right and left straight frames 8, 9.

The vehicle body 2 is provided with yoke angle sensors 16*a*, 16*b* (the right yoke angle sensor is not shown in the drawing) for detecting the pivoting angle of each yoke 13, that is, the pivoting angle of each of the blade lift cylinders 11, 12. The blade lift cylinders 11, 12 are respectively provided with stroke sensors 19*a*, 19*b* (shown in FIG. 3 only) for detecting the strokes of the blade lift cylinders 11, 12. As seen from the hydraulic circuit diagram of FIG. 3, hydraulic pressure sensors 17H, 17B for respectively detecting hydraulic pressures on the heads and bottoms of the respective blade lift cylinders 11, 12 are disposed in a hydraulic pipe line for providing hydraulic pressure to the heads and bottoms of the blade lift cylinders 11, 12. The outputs of the yoke angle sensors 16*a*, 16*b*, stroke sensors 19*a*, 19*b*, and hydraulic pressure sensors 17H, 17B are entered in a controller 18 consisting of a microcomputer which in turn uses the output data in the calculation of a vertical reaction force on the blade 7 (to be described later).

Figure 4:
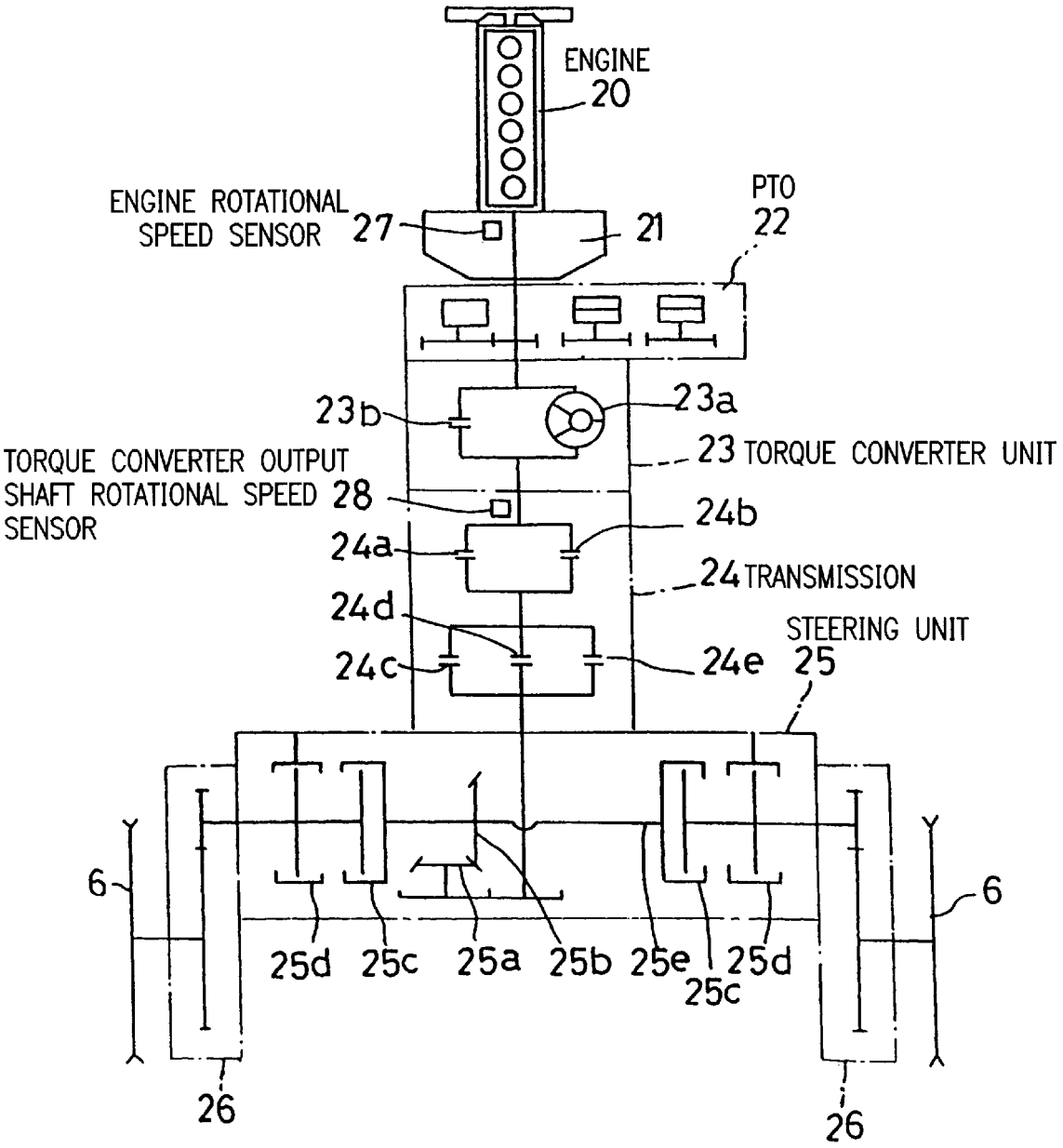
FIG. 4 is a skeleton diagram of a power transmission system.

In FIG. 4 showing a power transmission system, a rotary driving force from the engine 20 is transmitted to a PTO 22 for driving a dumper 21 and various hydraulic pumps including a work machine hydraulic pump and then to a torque convertor unit 23 having a torque convertor 23*a* and a lock-up clutch 23*b*. The rotary driving force is then transmitted from the output shaft of the torque convertor unit 23 to a transmission 24 (e.g., wet multiple disc clutch type planetary gear transmission) whose input shaft is coupled to the above output shaft. The transmission 24 comprises a forward drive clutch 24*a*, reverse drive clutch 24*b* and first to third speed clutches 24*c*, 24*d* and 24*e*, so that the output shaft of the transmission 24 is rotated in three speed ranges in both forward and reverse drive. The rotary driving force from the output shaft of the transmission 24 is transmitted to paired right and left final reduction gears 26 through a steering unit 25 to drive the respective sprockets 6 for running the crawler belts 6 (not shown in FIG. 4). The steering unit 25 has a transverse shaft 25*e* having a pinion 25*a*, a bevel gear 25*b*, paired right and left steering clutches 25*c* and paired right and left steering brakes 25*d*. Reference numeral 27 denotes an engine rotational speed sensor for detecting the rotational speed of the engine 20 whereas reference numeral 28 denotes a torque convertor output shaft rotational speed sensor for detecting the rotational speed of the output shaft of the torque convertor unit 23.

The data on the rotational speed of the engine 20 sent from the engine rotational speed sensor 27, the data on the rotational speed of the output shaft of the torque convertor unit 23 sent from the torque convertor output shaft rotational speed sensor 28 and a lock-up clutch on/off instruction sent from a lock-up changer-over switch (not shown) as to whether or not the torque convertor unit 23 is to be locked up are all inputted to the controller 18 (see FIG. 3) to be used in the calculation of a horizontal reaction force (actual tractive force) exerted on the blade 7 (to be described later).

Figure 3:
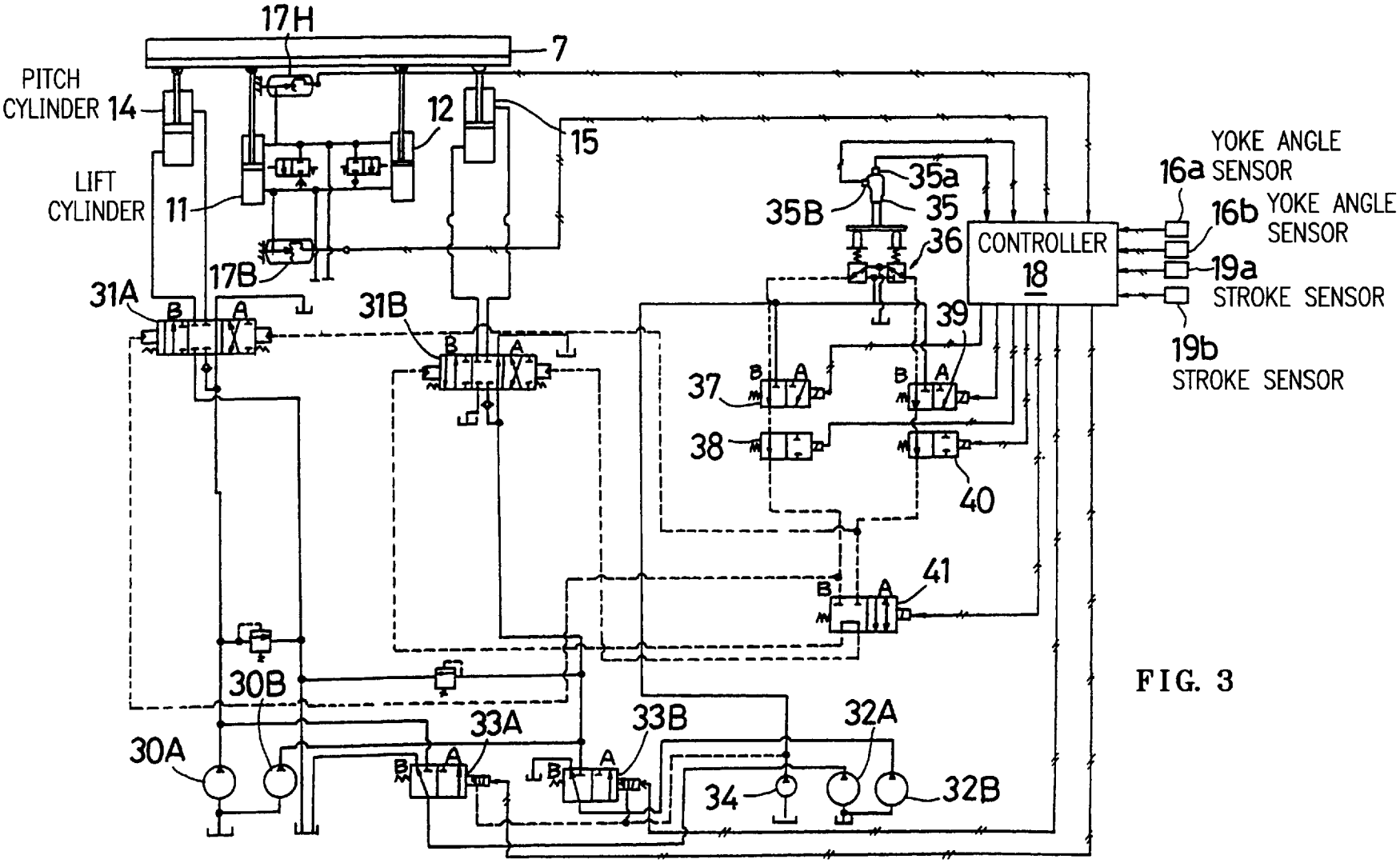
FIG. 3 is a hydraulic circuit diagram showing a pitch operation circuit for a blade.

Reference is made to FIG. 3 for explaining a pitch operation circuit for operating the blade 7 with the blade pitch cylinders 14, 15 according to the embodiment. It should be noted that a lift operation circuit for operating the blade 7 with the blade lift cylinders 11, 12 is omitted from this hydraulic circuit.

In the hydraulic circuit diagram, a first directional control valve 31A is connected to the discharge pipe line of a fixed capacity type hydraulic pump 30A for supplying hydraulic pressure to the left blade pitch cylinder 14 while a second directional control valve 31B is connected to the discharge pipe line of a fixed capacity type hydraulic pump 30B for supplying hydraulic pressure to the right blade pitch cylinder 15. The discharge pipe line of an assist hydraulic pump 32A is connected to the discharge pipe line of the hydraulic pump 30A through an assist solenoid valve 33A. The discharge pipe line of an assist hydraulic pump 32B is connected to the discharge pipe line of the hydraulic pump 30B through an assist solenoid valve 33B.

The discharge pipe line of a pilot pump 34 is connected to a pilot control valve 36 for an operation lever 35. The pilot control valve 36 is connected to a left tilt control valve 38 through a pitch back control valve 37 and to a right tilt control valve 40 through a pitch forward control valve 39. The pilot control valve 36 is connected to the second directional control valve 31B through a pitch/tilt switching solenoid valve 41. The pilot control valve 36 is also connected to the first directional control valve 31A through the pitch back control valve 37, left tilt control valve 38, pitch forward control valve 39 and right tilt control valve 40.

The above operation lever 35 is provided with a pitch back change-over switch 35A and a pitch forward change-over switch 35B, these switches 35A, 35B being connected to the controller 18.

The output signal of the controller 18 is inputted to the assist solenoid valves 33A, 33B, pitch back control valve 37, pitch forward control valve 39, left tilt control valve 38, right tilt control valve 40 and pitch/tilt switching solenoid valve 41 to control these valves.

Next, the reaction forces exerted on the blade 7 during the dozing operation by the blade 7 will be explained with reference to FIG. 5. It should be noted that the hatched part of FIG. 5 is earth pushed over the surface of the blade 7 during the digging operation by the blade 7.

Figure 5:
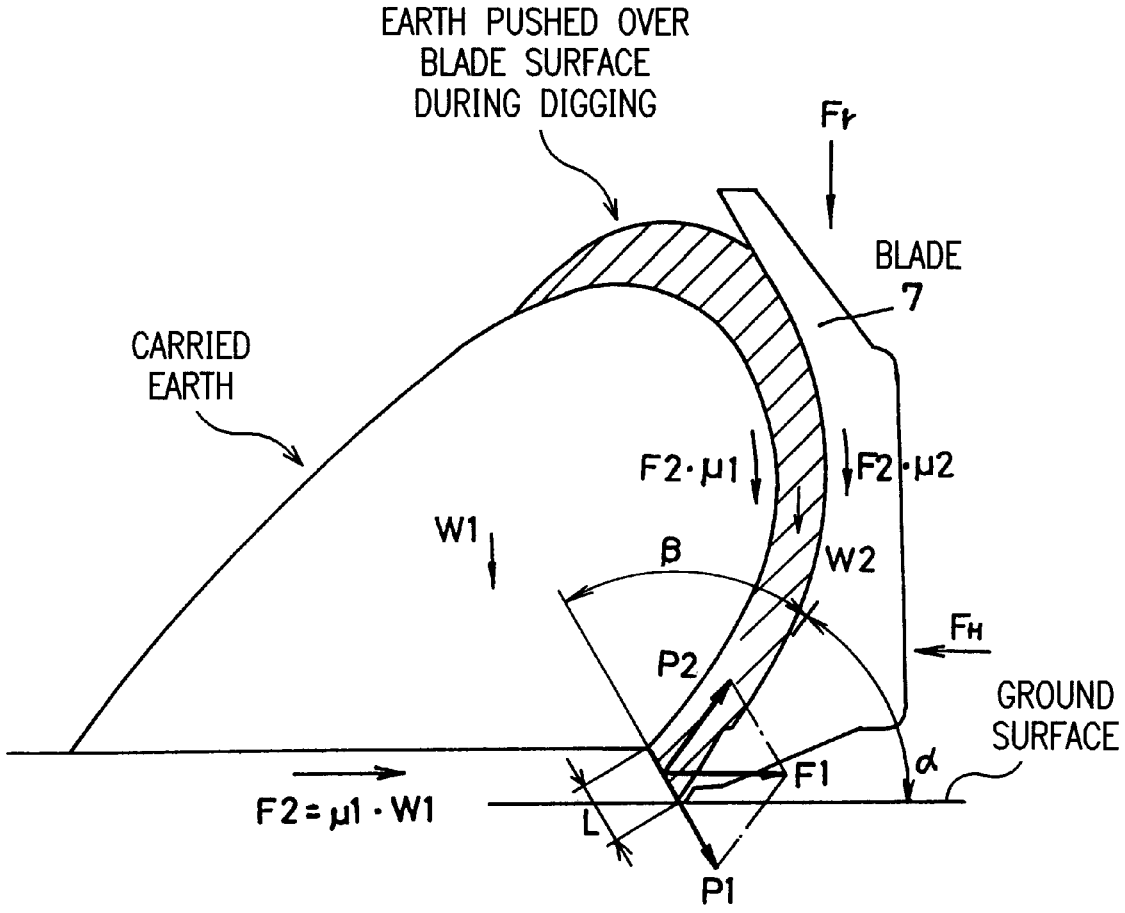
FIG. 5 is a diagram used to explain reaction forces exerted on the blade.

A horizontal reaction force $F_H$ (=the actual tractive force of the crawler belts 5) exerted on the blade 7 is described by the following equation where digging resistance is F1 and carrying resistance (the friction caused between earth W1 and the ground) is F2 as shown in FIG. 5.

$$F_H = F1 + F2$$

F1 and F2 are respectively described by:

$$F1 + P1 \times \cos(180° - \alpha - \beta) + P2 \times \cos \alpha$$

$$F2 = \mu 1 \times W1$$

where P1 is a shearing force and P2 is a force for raising the earth indicated by hatching in FIG. 5. P1 and P2 are respectively specified by the following equations.

$$P1 = L\tau B$$

(L: shearing length, τ: shearing stress, B: width of the blade)

$$P2 = W2 + F2(\mu 1 + \mu 2)$$

($\mu$1: coefficient of friction between soils, $\mu$2: coefficient of friction between soil and the blade)

A vertical reaction force $F_V$ exerted on the blade 7 (=the pressing force of the blade lift cylinders 11, 12) is described by:

$$F_V = P1 \times \sin(180° - \alpha - \beta) - P2 \times \sin \alpha$$

Figure 6:
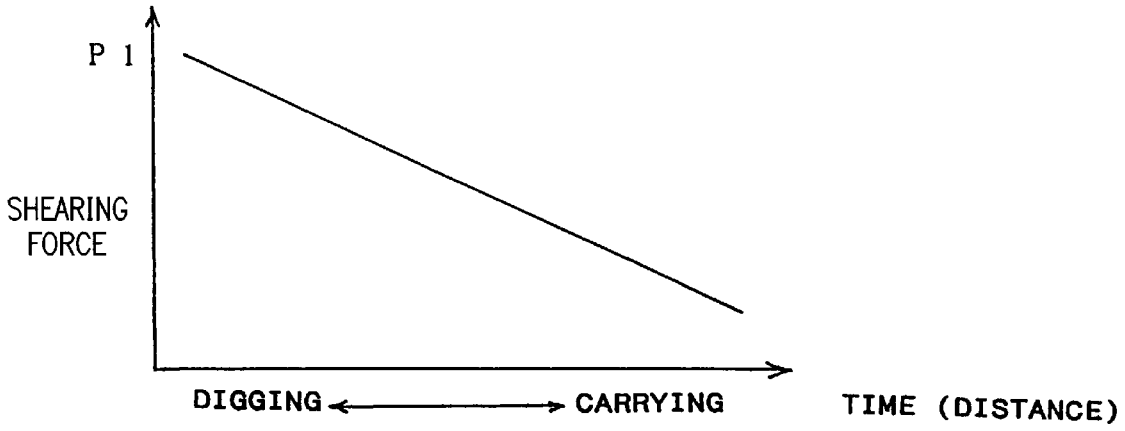
FIG. 6(*a*) is a graph showing the change of shearing force exerted on the blade.
Figure 6:
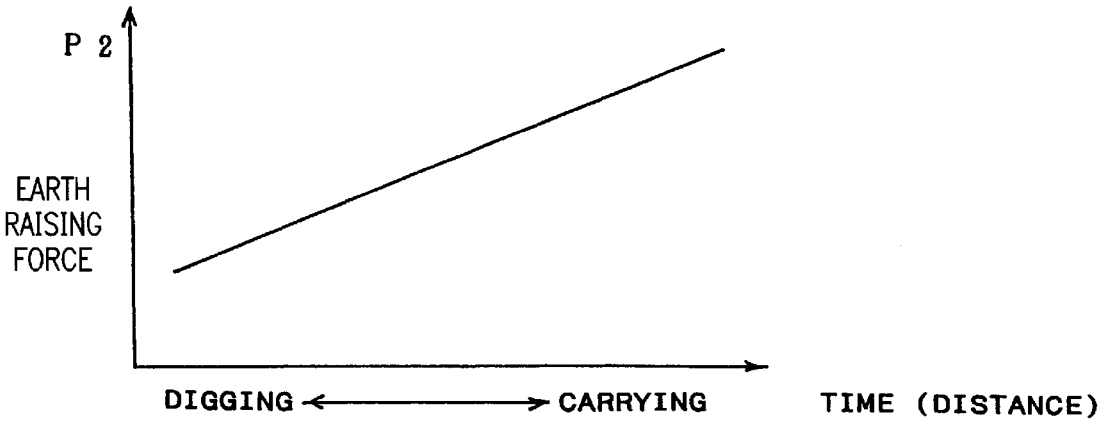
Figure 7:
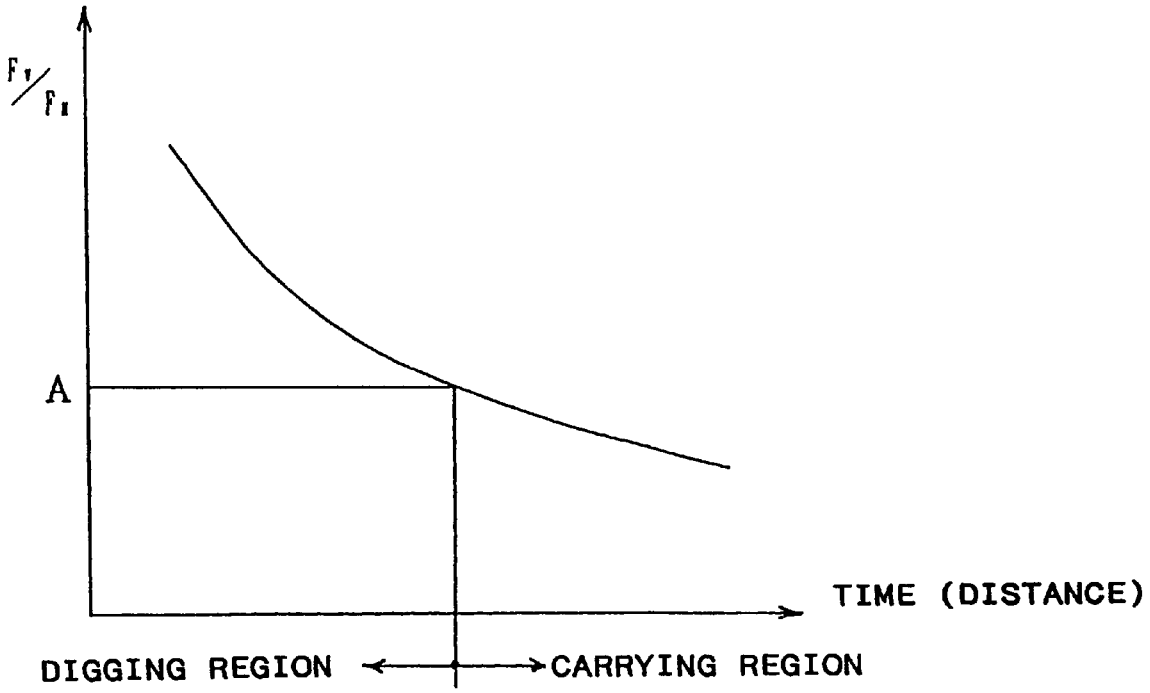
FIG. 7 is a graph showing the change of the ratio of the vertical reaction force to the horizontal reaction force.

Whereas the shearing force P1 linearly changes so as to take large values during the digging operation and to take small values during the carrying operation as shown in FIG. 6(*a*), the earth raising force P2 linearly changes so as to take small values during the digging operation and to take large, values during the carrying operation as shown in FIG. 6(*b*). Hence, as seen from FIG. 7, when the ratio ($F_V/F_H$) of the vertical reaction force $F_V$ to the horizontal reaction force $F_H$ is obtained, the ratio of the shearing force P1 to the horizontal reaction force $F_H$ is great, with the ratio $F_V/F_H$ being great during the digging operation, while W1 is great so that the ratio $F_V/F_H$ is small during the carrying operation.

Accordingly, the amount of earth (earthwork) accumulated on the front face of the blade 7, that is, the load factor of the blade 7 can be obtained by calculating the ratio $F_V/F_H$ and informing it to the operator. In other words, whether the dozing operation is in a digging state or a carrying state can be understood by knowing whether the value of the ratio $F_V/F_H$ is above or below a specified value A (see FIG. 7).

Figure 8:
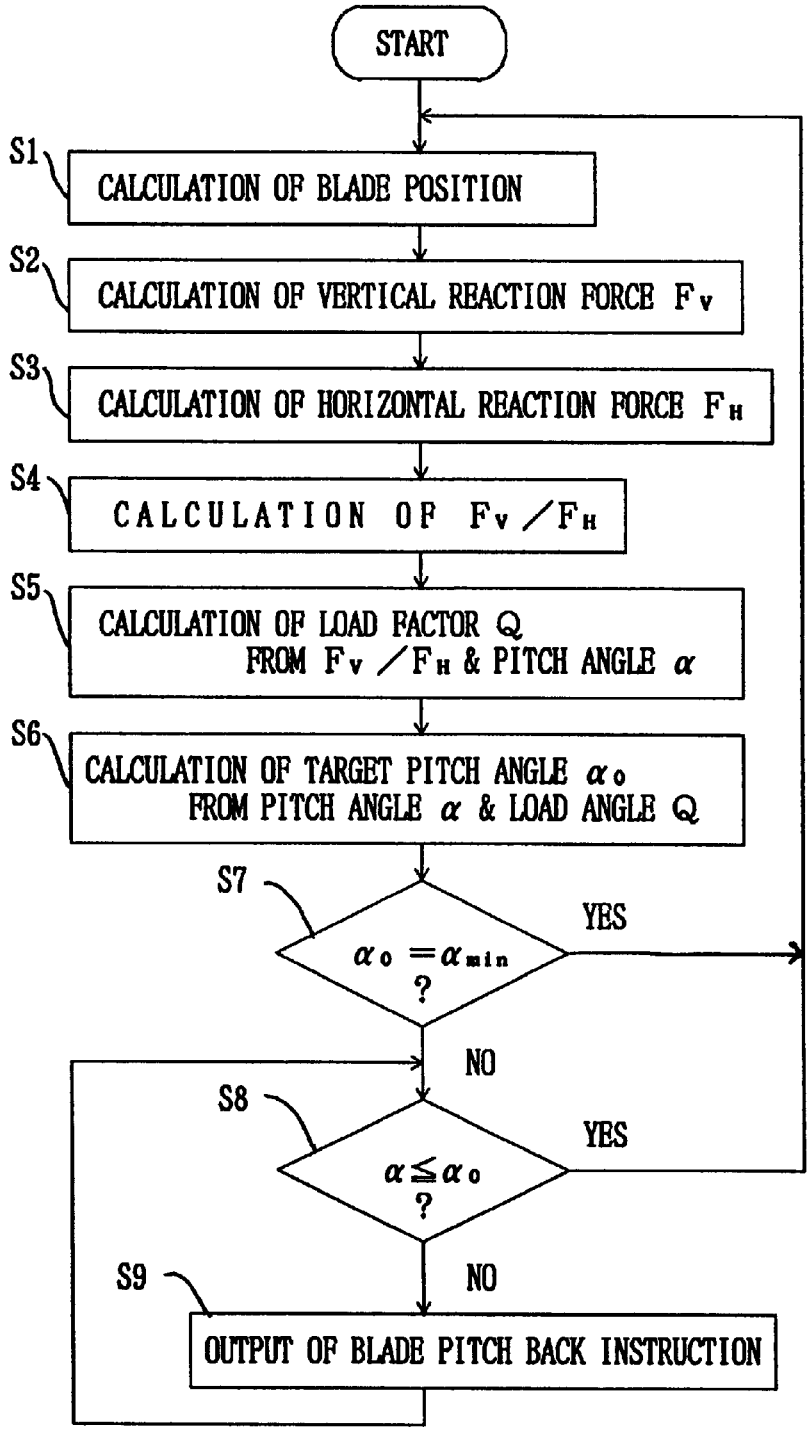
FIG. 8 is a flow chart of pitch back control for the blade.

Whether the dozing operation is in a digging state or a carrying state is thus determined by detecting the load factor of the blade 7 so that the blade 7 can be automatically changed from a digging position to a carrying position (i.e., pitch back (backward inclination) position) based on the above determination. The control process for changing the position of the blade 7 will be hereinafter described referring to the flow chart of FIG. 8 and to the hydraulic circuit diagram of FIG. 3.

S1: The present position of the blade 7 is obtained by calculation. The blade 7 has freedom of three kinds of movement, i.e., lifting (raised or lowered), tilting (lateral inclination) and pitching (forward and backward inclination) so that the position of the blade 7 can be determined by determining three parameters. Namely, the position of the blade 7 can be determined according to the average θ of yoke angles obtained by the right and left yoke angle sensors 16*a*, 16*b* and to a pitch angle α (see FIG. 9) obtained by the stroke sensors 19*a*, 19*b*. It should be noted that the value of normal digging depth may be used in place of the outputs of the stroke sensors 19*a*, 19*b*.

S2: The vertical reaction force $F_V$ (=the pressing force of the blade lift cylinders 11,12) exerted on the blade 7 is calculated in the following way.

Where the average value of hydraulic pressures detected on the respective heads of the blade lift cylinders 11, 12 by the hydraulic pressure sensor 17H is $P_H$; the sectional area of each head is $A_H$; the average value of hydraulic pressures detected on the respective bottoms of the blade lift cylinders 11, 12 by the hydraulic pressure sensor 17B is $P_B$; and the sectional area of each bottom is $A_B$, the total of axial force (cylinder pressing force) $F_C$ exerted on the two cylinder rods of these blade lift cylinders 11, 12 is described by:

$$F_C=(P_BA_B-P_HA_H)\times \quad 2$$

Figure 9:
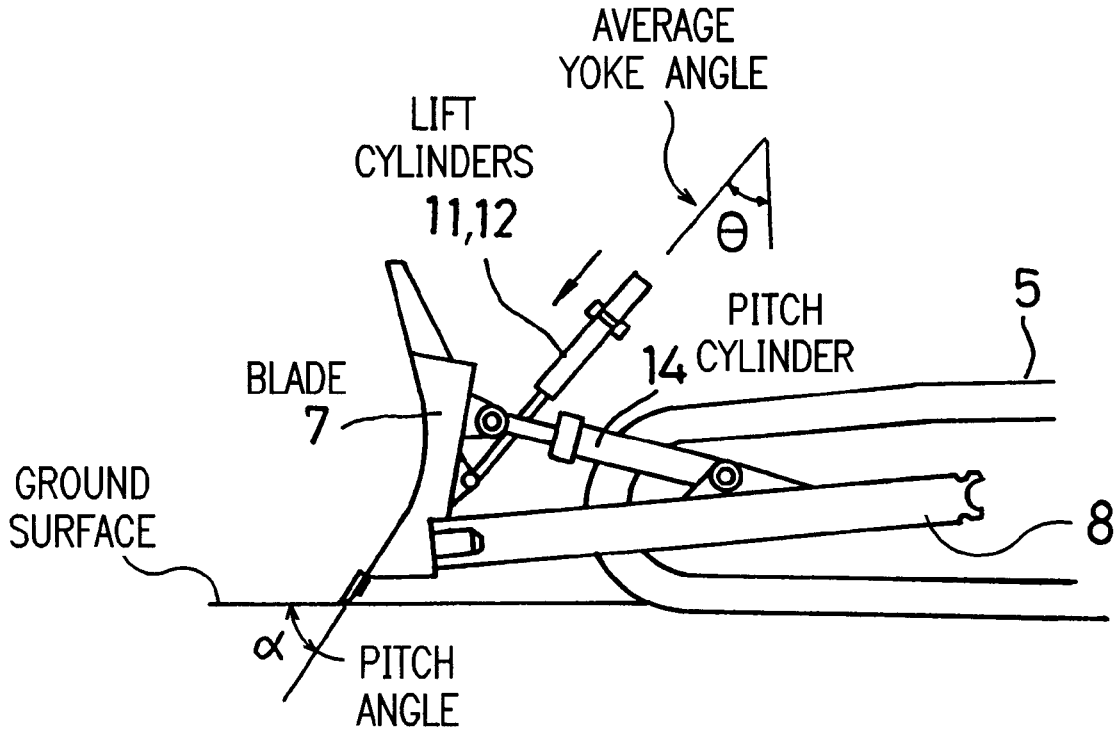
FIG. 9 is a diagram used to explain yoke angle and pitch angle.

Accordingly, the vertical reaction force $F_V$ is obtained by:

$$F_V=F_C\cos\theta$$

where the average value of right and left yoke angles detected by the yoke angle sensors 16*a*, 16*b* is θ (see FIG. 9).

S3: The horizontal reaction force $F_H$ (=the actual tractive force of the crawler belts 5) exerted on the blade 7 is calculated in the following way.

When the transmission 24 is placed in the first speed range of forward drive (F1) or in the second speed range of forward drive (F2), an actual tractive force $F_R$ is calculated in the following way according to whether the torque convertor unit 23 is in its locked up state or its torque converting state.

1. Locked-up state

Figure 10:
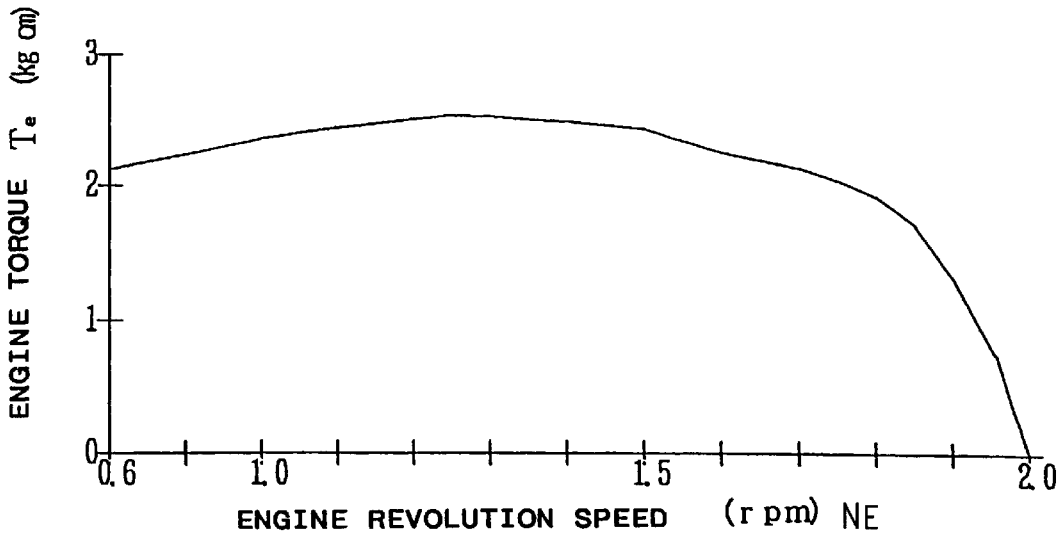
FIG. 10 illustrates a map of an engine characteristic curve.
Figure 11:
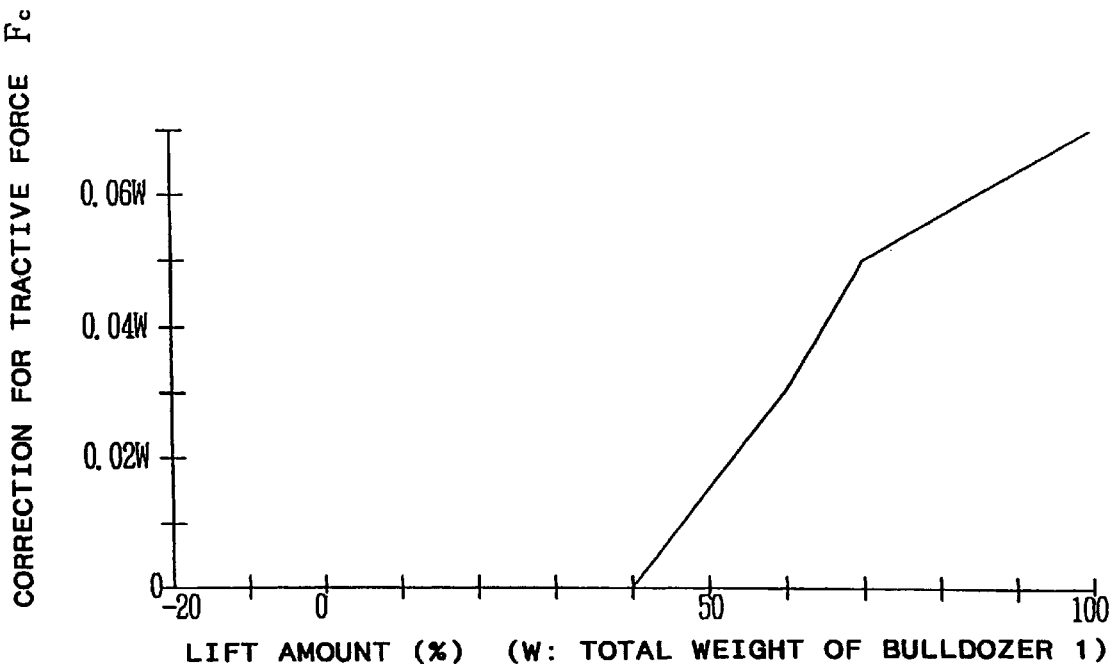
FIG. 11 illustrates a map of a pump correction characteristic line.

An engine torque Te is obtained from the engine characteristic curve map as shown in FIG. 10, using the rotational speed $N_E$ Of the engine 20. Then, the engine torque Te is multiplied by a reduction ratio $K_{se}$ between the transmission 24, the steering unit 25 and the final reduction gears 26) (i.e., from the output shaft of the torque convertor unit 23 to the sprockets 6) and further multiplied by the radius r of the sprockets 6 thereby to obtain a tractive force Fe ($=Te\times K_{se}\times r$). A tractive force correction value Fc is subtracted force the tractive force Fe to obtain an actual tractive force $F_R$ (=Fe−Fc). The above tractive force correction value Fc corresponds to the discharge amount of the work machine hydraulic pressure pump etc. of the PTO 22 relative to the blade lift cylinders 11, 12, this amount being obtained from the pump correction characteristic map as shown in FIG. 11 using the lift operating amount of the blade 7.

2. Torque converting state

Figure 12:
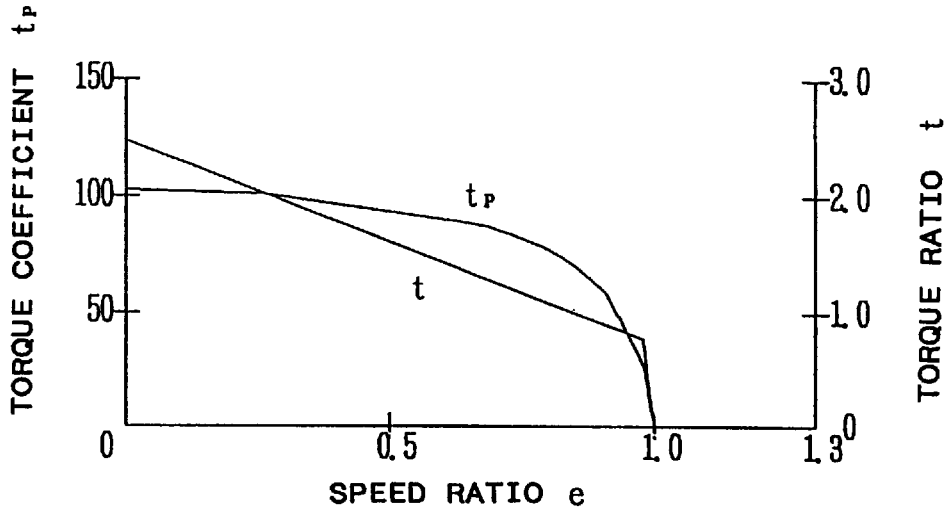
FIG. 12 illustrates a map of a torque convertor characteristic curve.

A torque coefficient $t_p$ and torque ratio t are obtained from the torque convertor characteristic curve map as shown in FIG. 12, using a speed ratio e ($=Nt/N_E$) that is the ratio of the rotational speed $N_t$ of the output shaft of the torque convertor unit 23 to the rotational speed $N_E$ of the engine 20. From the torque coefficient $t_p$ and torque ratio t, a torque Tc output from the torque convertor ($=t_p\times(N_E/100)^2\times t$) is obtained. Then, the torque convertor output torque Tc is multiplied by the reduction ratio $K_{se}$ between the output shaft of the torque convertor unit 23 and the sprockets 6 and by the radius r of the sprockets 6 similarly to the case of "locked-up state", thereby obtaining an actual tractive force $F_R(=Tc\times K_{se}\times r)$.

Figure 13:
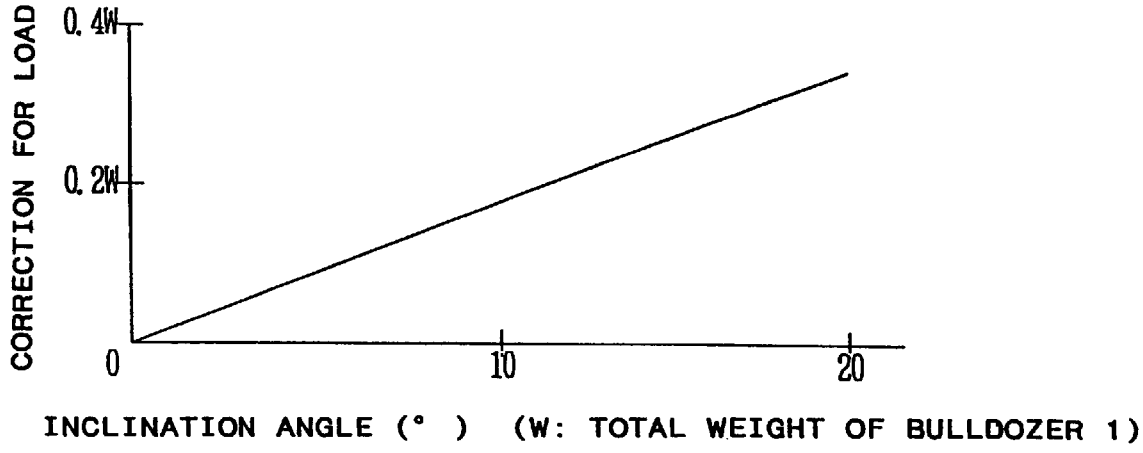
FIG. 13 illustrates a map of inclination angle to load correction characteristic.

A load correction value is subtracted from the actual tractive force $F_R$ thus obtained to obtain a corrected actual tractive force, that is, a horizontal reaction force $F_H$. The above load correction value corresponds to the inclination angle of the vehicle body 2 and is obtained from the inclination angle to load correction value characteristic map as shown in FIG. 13.

S4: Now that the vertical reaction force $F_V$ and the horizontal reaction force $F_H$ are obtained, the controller 18 calculates the ratio $F_V/F_H$. As the value of the ratio $F_V/F_H$ is large during the digging operation and small during the carrying operation (see FIG. 7), it can be an indication for switching from digging to carrying.

Figure 14:
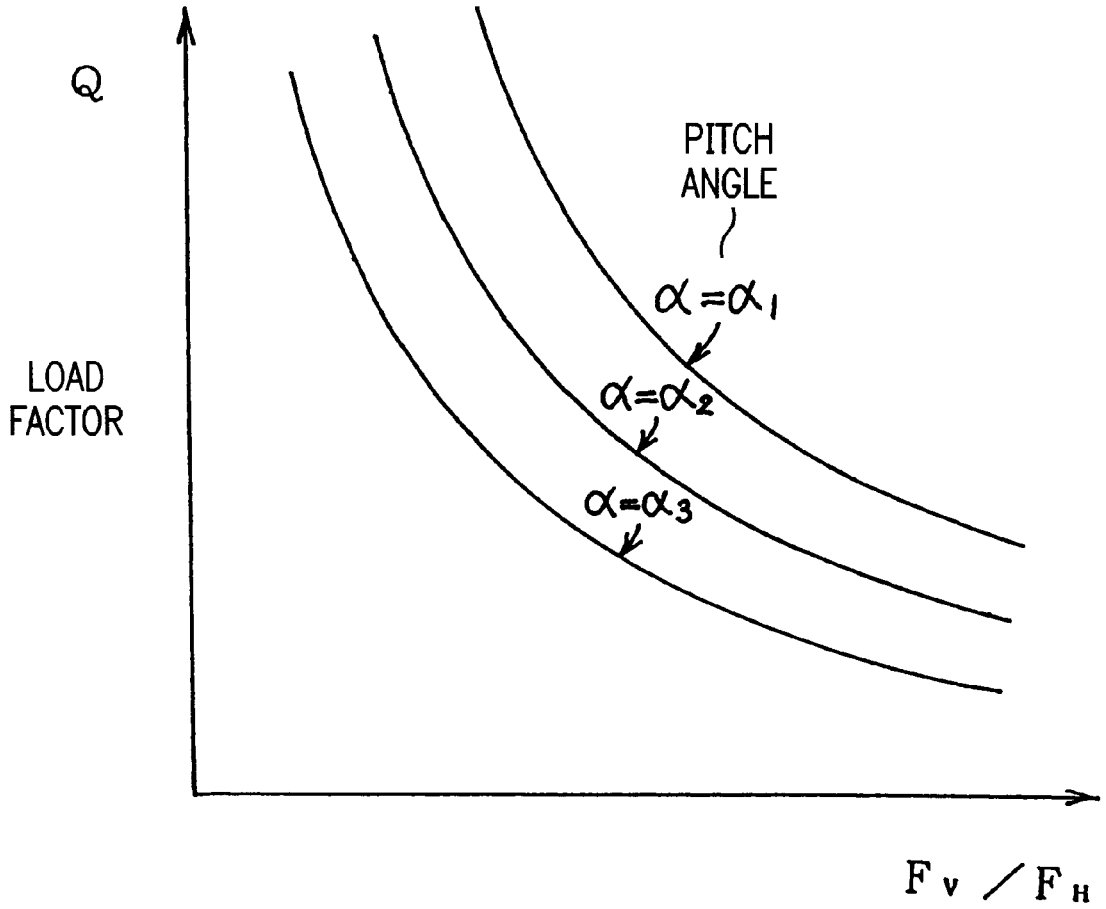
FIG. 14 is a graph showing the relationship between the ratio of $F_V/F_H$ and the load factor Q.
Figure 15:
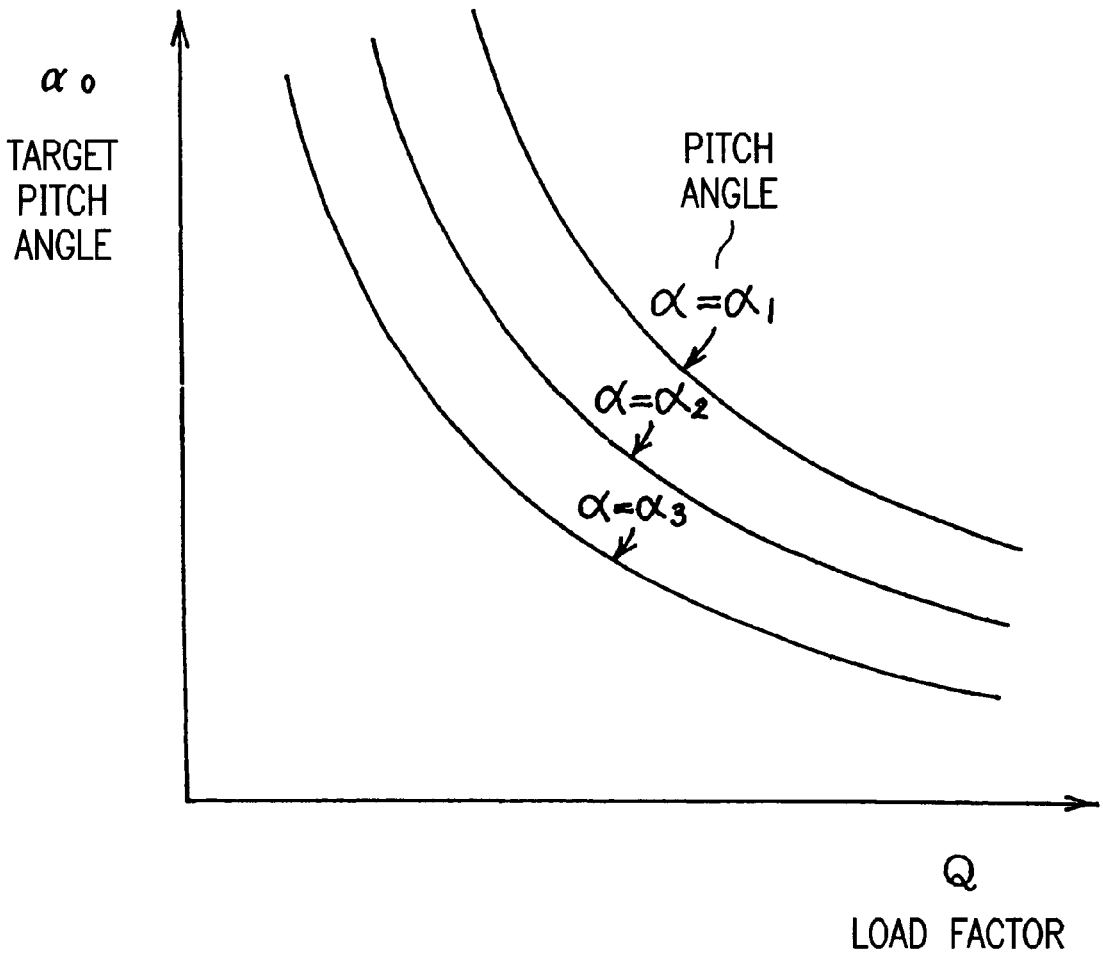
FIG. 15 is a graph showing the relationship between the load factor and the target pitch angle.

S5 to S6: As shown in FIG. 14, the ratio $F_V/F_H$ is correlated with the load factor Q with a pitch angle α of the blade 7 serving as a parameter and hence, the load factor Q is obtained from the $F_V/F_H$ and the pitch angle α. Then, a target pitch angle $\alpha_0$ is obtained from the load factor Q and the pitch angle α according to the map shown in FIG. 15.

S7 to S9: If the target pitch angle $\alpha_0$ is not a minimum pitch angle $\alpha_{min}$ and the present pitch angle α has not reached the target pitch angle $\alpha_0$ ($\alpha>\alpha_0$), the controller 18 outputs a blade pitch back instruction and the program returns to Step S8. If the target pitch angle $\alpha_0$ is equal to the minimum pitch angle $\alpha_{min}$ the program returns to Step S1. If a $\alpha\neq\alpha_{min}$ and the present pitch angle α has reached the target pitch angle $\alpha_0$ ($\alpha\leqq\alpha_0$), the program also returns to Step S1.

Figure 16:
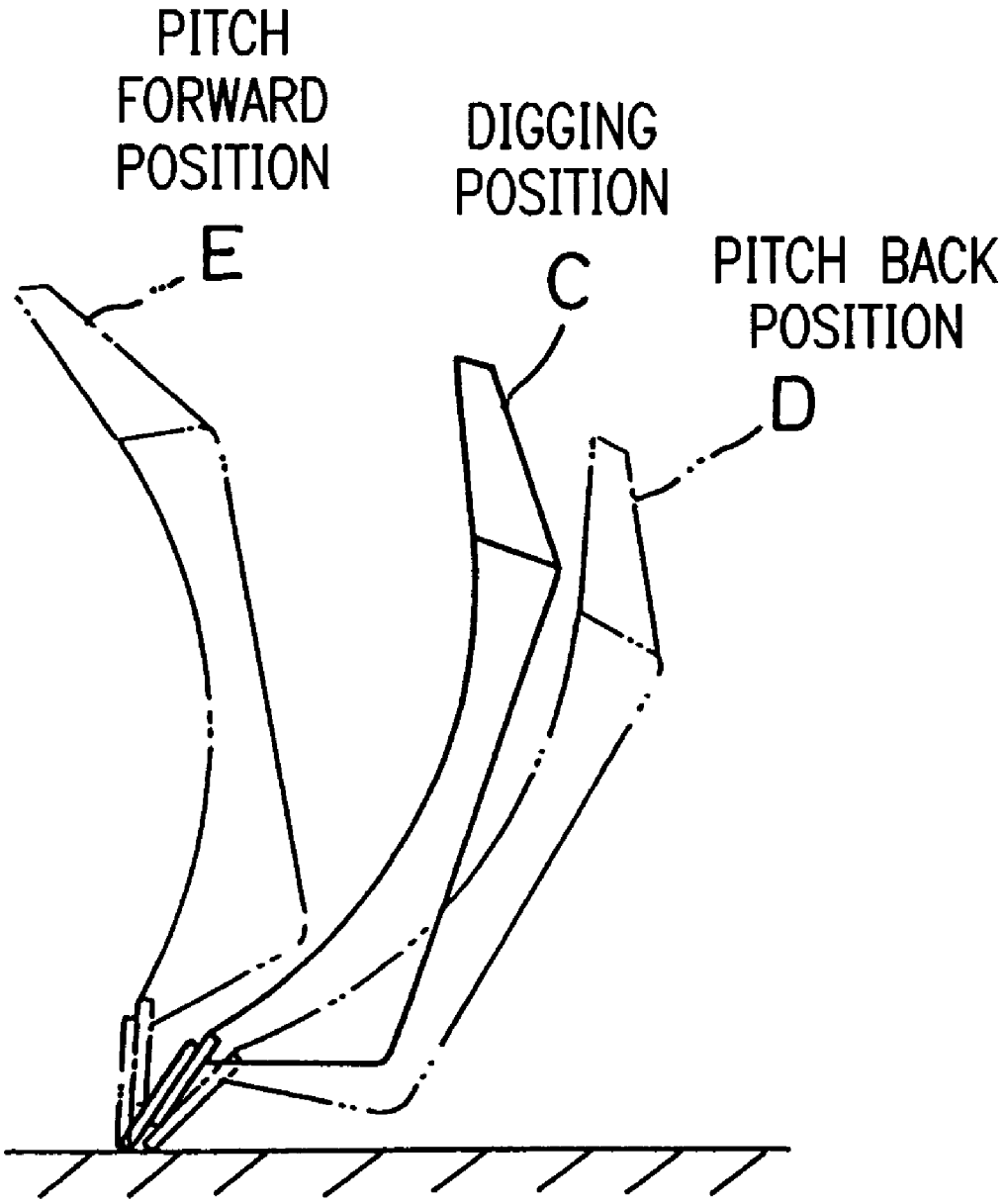
FIG. 16 is a diagram illustrating the positions of the blade.

After a blade pitch back instruction has issued from the controller 18, the pitch back control valve 37 is shifted to its Position A and the pitch/tilt switching solenoid valve 41 is shifted to its Position A. In the mean time, an instruction signal is sent from the controller 18 to the assist solenoid valves 33A, 33B so that these valves 33A, 33B are shifted to their Position A. Therefore, the flow of pressurized oil discharged from the assist hydraulic pumps 32A, 32B joins the flow in the discharge pipe line of the hydraulic pumps 30A, 30B. At that time, the pilot pressure of the pilot pump 34 is exerted on the operation section of the first directional control valve 31A through the pitch back control valve 37 and the left tilt control valve 38 and exerted on the operation section of the second directional control valve 31B through the pitch back control valve 37, the left tilt control valve 38 and the pitch/tilt switching solenoid valve 41. This allows the first directional control valve 31A and the second directional control valve 31B to be shifted to their Position B so that the pressurized oil discharged from the hydraulic pump 30A is flowing into the head chamber of the blade pitch cylinder 14 through the first directional control valve 31A while the pressurized oil discharged from the hydraulic pump 30B is flowing into the head chamber of the blade pitch cylinder 15 through the second directional control valve 31B. In this way, the blade pitch cylinders 14, 15 are simultaneously shortened and the blade 7 promptly pitches back (backward inclination) so that the blade 7 is moved from a digging position C into a carrying position (pitch back position) D as shown in FIG. 16.

Figure 17:
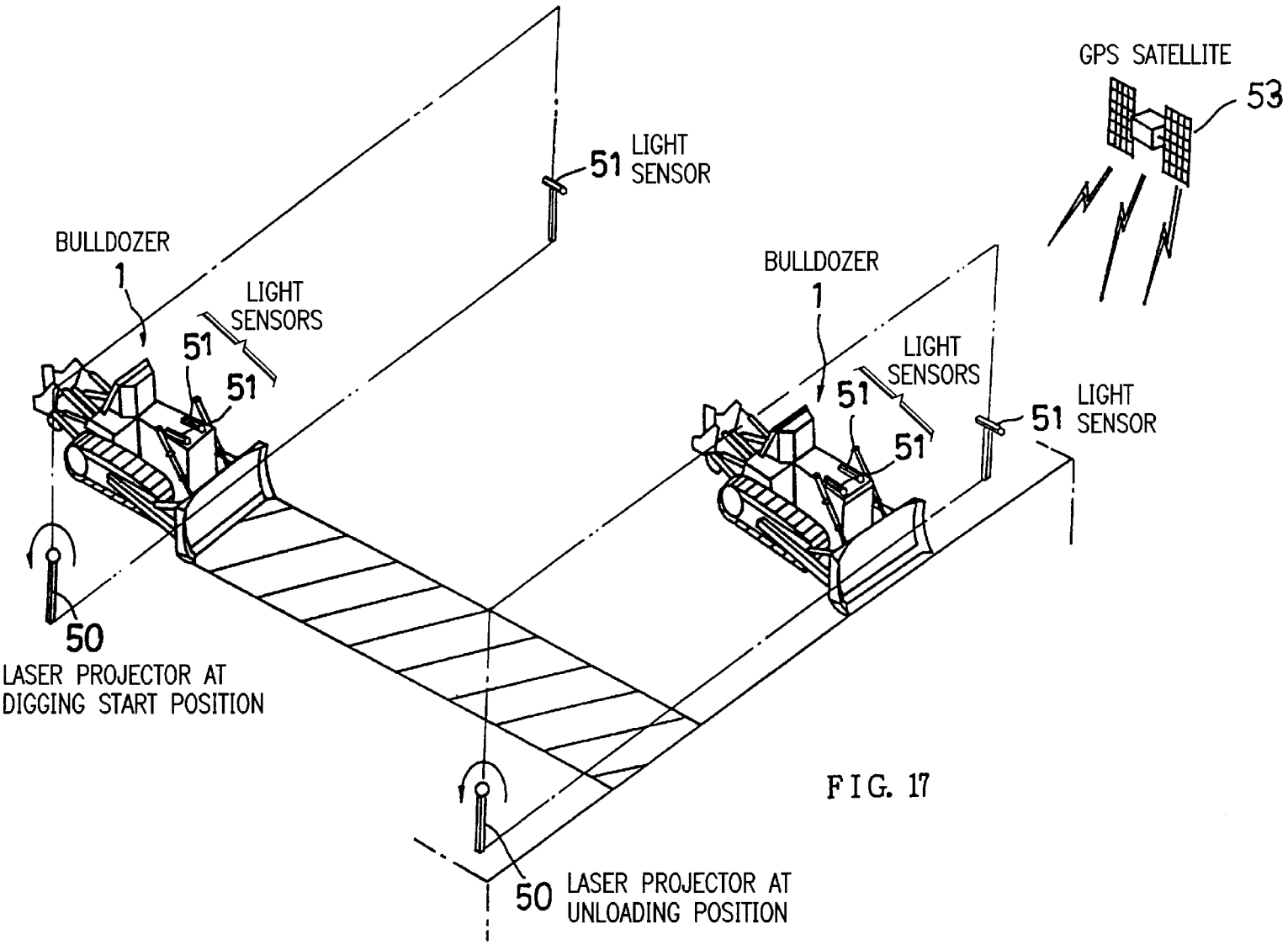
FIG. 17 is a diagram used to explain automatic drive control.

According to this embodiment, an earth unloading position is preferably detected by an unloading position detecting means constituted by a laser projector 50 and a pair of laser light receiving sensors 51. More specifically, the laser projector 50 having a laser irradiating section that is rotatable about a horizontal axis parallel to the traveling direction of the bulldozer 1 is disposed as shown in FIG. 17 on the ground at an earth unloading position where dug soil or earth is unloaded and the pair of laser light receiving sensors 51 for receiving laser beams from the laser projector 50 are disposed side by side on the bonnet 3 of the bulldozer 1. Use of such an unloading position detecting means enables an operation wherein the bulldozer 1 with the blade 7 in the pitch back position D moves forward to the earth unloading position; the controller 18 outputs a blade pitch forward instruction when the bulldozer 1 has reached the earth unloading position; and the blade 7 is automatically moved into the pitch forward (forward inclination) position E to dump earth. It should be noted that in this embodiment, another laser light receiving sensor 51 is placed on the ground so as to face the laser light projector 50 and with this sensor 51, the light projected from the laser projector 50 is detected for confirmation.

When the controller 18 has outputted a blade pitch forward instruction, the pitch forward control valve 39 is shifted to its Position A and the pitch/tilt switching solenoid valve 41 is shifted to its Position A. In the mean time, an instruction signal from the controller 18 is inputted to the assist solenoid valves 33A, 33B so that they are shifted to their Position A. This allows the flow of pressurized oil discharged from the assist hydraulic pumps 32A, 32B to join the flow in the discharge pipe line of the hydraulic pumps 30A, 30B. At that time, the pilot pressure from the pilot pump 34 is exerted on the operation section of the first directional control valve 31A through the pitch forward control valve 39 and the right tilt control valve 40 and exerted on the operation section of the second directional control valve 31B through the pitch back control valve 37, the left tilt control valve 38 and the pitch/tilt switching solenoid valve 41. This allows the first directional control valve 31A and the second directional control valve 31B to be shifted to their Position A so that the pressurized oil discharged from the hydraulic pump 30A is flowing into the bottom chamber of the blade pitch cylinder 14 through the first directional control valve 31A while the pressurized oil discharged from the hydraulic pump 30B is flowing into the bottom chamber of the blade pitch cylinder 15 through the second directional control valve 31B. In this way, the blade pitch cylinders 14, 15 are simultaneously elongated and the blade 7 promptly pitches forward (forward inclination) so that the blade 7 is moved from the pitch back position D into the pitch forward position E as shown in FIG. 16.

While the pitch back control and pitch forward control of the blade 7 are automatically performed in the foregoing operation, pitching back and pitching forward may be carried out manually, by turning ON of the pitch back change-over switch 35A or pitch forward change-over switch 35B of the operation lever 35. In addition, with the pitch back change-over switch 35A and the pitch forward change-over switch 35B turned OFF, the blade 7 can be tilted to the right by moving the operation lever 35 to the right; tilted to the left by moving the operation lever 35 to the left; lifted by moving the operation lever 35 backwardly; and lowered by moving the operation lever 35 forwardly. By moving the operation lever 35 forwardly with the pitch back change-over switch 35A turned ON, the blade 7 can be lowered while pitching back. By moving the operation lever 35 backwardly with the pitch forward change-over switch 35B turned ON, the blade 7 can be lifted while pitching forwardly. Such manual operation by use of the operation lever 35 is performed in preference to the above-described automatic operation.

Figure 18:
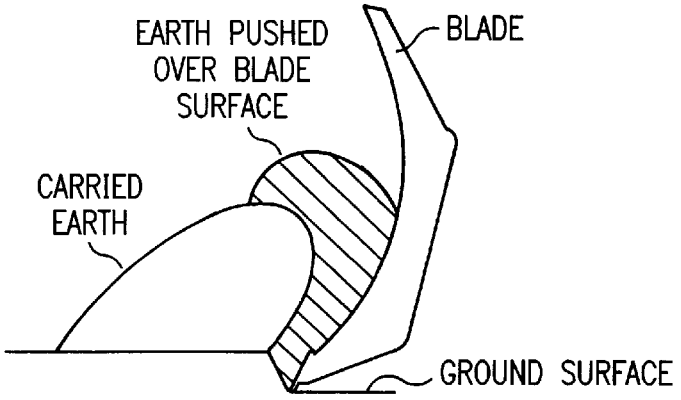
FIGS. 18(*a*), 18(*b*) and 18(*c*) illustrate examples of pictures displayed on a display panel.
Figure 18:
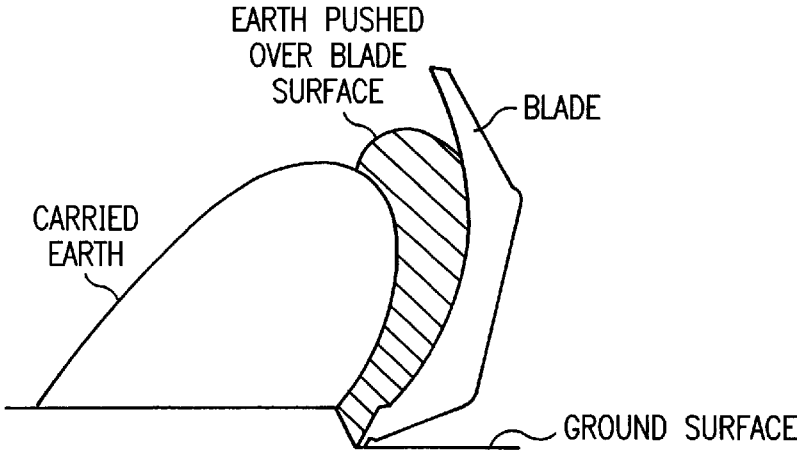
Figure 18:
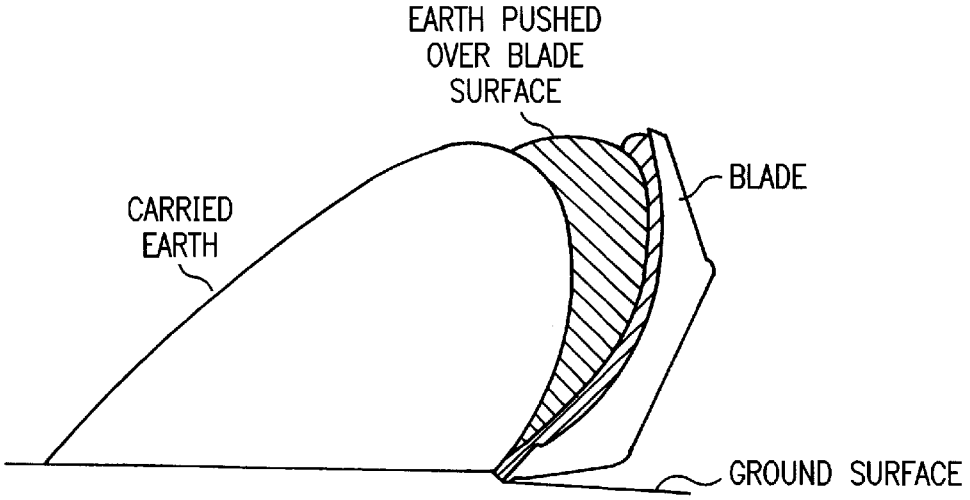

In the bulldozer 1 according to this embodiment, a display panel provided in the operator's cab 4 displays the value of the load factor Q which changes momentarily and is obtained from calculation as described before. One example of the presentation on the display panel is shown in FIGS. 18(*a*)–18(*c*). The present amount of earth accumulated on the front face of the blade 7 in the dozing operation may be indicated by a picture on the display panel as shown in FIGS. 18(*a*)–18(*c*) according to the calculated load factor Q, which allows the operator to grasp the load factor Q at a glance. With this arrangement, the operator can operate the blade 7 with high efficiency when manually shifting it from the digging position C to the pitch back position D. FIGS. 18(*a*) and 18(*b*) each indicate the load factor of the blade 7 in its digging state. FIG. 18(*c*) shows the load factor of the blade 7 in its carrying state.

For automatically driving the bulldozer 1 of this embodiment, a laser projector 50 similar to that disposed in the earth unloading position may be disposed on a digging start position as shown in FIG. 17. With this laser projector 50 and the laser light receiving sensors 51 disposed on the bulldozer 1, it becomes possible to detect that the bulldozer 1 is in the digging start position. In addition, the bulldozer 1 may be provided with a yaw rate gyro for detecting the yaw angle of the vehicle body 2 relative to a target traveling direction. In this arrangement, the presence of the bulldozer 1 at the digging start position is detected when a laser beam projected from the laser projector 50 disposed at the digging start position is received by the laser light receiving sensors 51 disposed on the bulldozer 1 whereas the presence of the bulldozer 1 at the earth unloading position is detected when a laser beam projected from the laser projector 50 disposed at the earth unloading position is received by the laser light receiving sensors 51 disposed on the bulldozer 1. Further, a deviation of the bulldozer 1 with respect to a target traveling direction can be calculated by integration of data obtained from the yaw rate gyro. In this way, the automatic drive control of the bulldozer 1 can be performed. It should be noted that the reason why a pair of laser light receiving sensors 51 are laterally disposed on the bulldozer 1 is that the angle between a vertical plane and the vehicle body 2 is detected by laser beams to check the traveling direction of the bulldozer 1. Specifically, the right and left laser light receiving sensors 51 detect the angle between a vertical plane and the vehicle body 2, for example, for every cycle (i.e., every reciprocal movement) of the bulldozer 1 and with the angle thus obtained, a reference value can be set or corrected to be used in the yaw rate gyro for obtaining the deviation amount of the bulldozer 1 relative to a target traveling direction.

Following is a description of the automatic drive control of the bulldozer 1 when reciprocating a plurality of times in one specified lane.

Firstly, the bulldozer 1 is guided to the digging start position and a digging direction is determined by manual operation by the operator. The operator also manually sets a load level, the speed range of the transmission 24 and the number of reciprocating movements and inputs a digging start instruction. After that, the forward drive clutch 24*a* of the transmission 24 is engaged while a selected speed clutch is engaged, so that the bulldozer 1 travels straight ahead to the earth unloading position. At that time, the traveling direction of the bulldozer 1 is detected by the yaw rate gyro and if the bulldozer 1 is found to deviate from a target traveling direction before starting dozing, the steering clutches 25*c* and the steering brakes 25*d* are actuated and controlled so that the traveling direction of the bulldozer 1 is corrected. After start of dozing, the blade 7 is lifted or lowered such that the load on the blade 7 becomes equal to a set load level. At this stage, if the yaw rate gyro detects a deviation of the bulldozer 1 from the target traveling direction, the blade 7 is tilted whereby the traveling direction of the bulldozer 1 is corrected.

Figure 19:
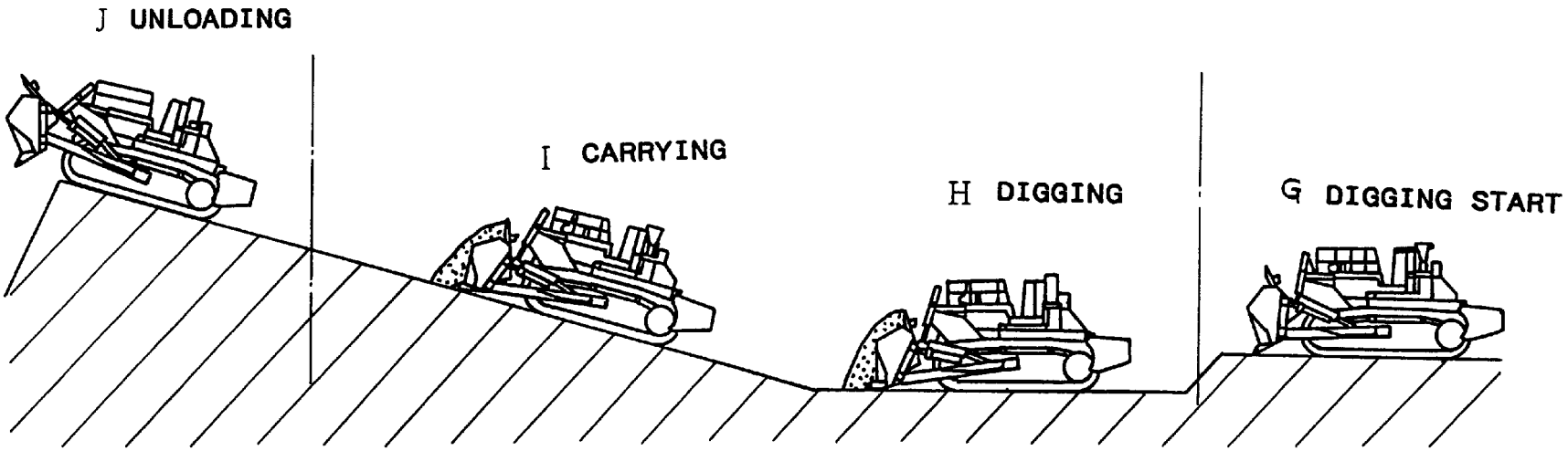
FIG. 19 illustrates the working process of the bulldozer.
Figure 20:
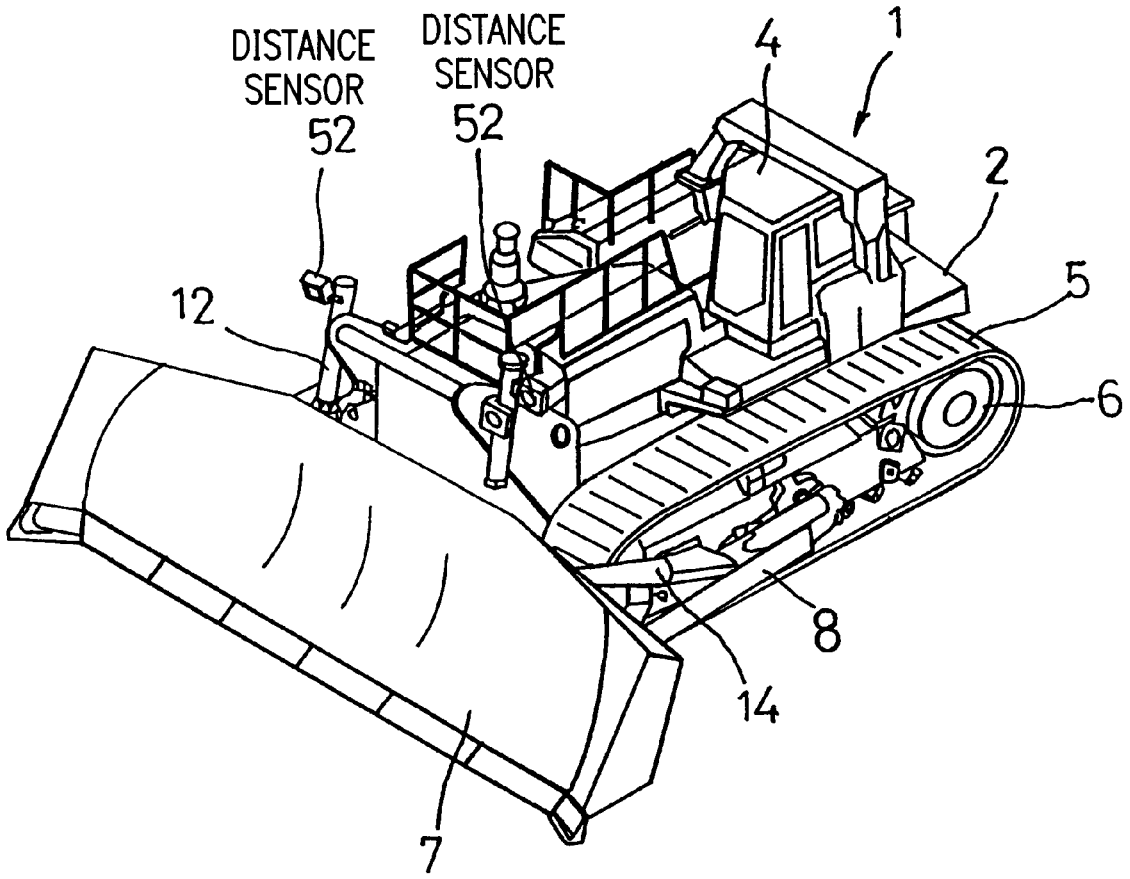
FIG. 20 illustrates another example of a bulldozer having a load factor calculating means.

In this way, digging starts from the digging start position shown in FIG. 19(G) and performs digging as shown in FIG. 19(H) with a specified pitch angle suited for soil property. Upon reaching a specified load factor, the blade 7 is lifted and pitched back, thereby being operated in a carrying mode as shown in FIG. 19(I). When the laser light receiving sensors 51 detect that the bulldozer 1 has reached the earth unloading position, the blade 7 is lifted and pitched forward so that soil is unloaded from the blade 7 (see FIG. 19(J)). The transmission 24 is then placed in reverse drive with the blade 7 raised to a specified level, so that the bulldozer 1 is reversely driven along the lane toward the digging start position. After the automatic dozing operation by such forward and reverse driving has been repeated a specified number of times, the bulldozer 1 automatically stops and lane change is carried out by manual operation.

While the position of the bulldozer 1 is detected by the laser projectors 50 and the laser light receiving sensors 51 in the automatic drive control of this embodiment, the detection of the bulldozer's position may be carried out by use of at least one laser light projecting/receiving device disposed on the ground and a reflector (corner cube linear array) disposed on the operator's cab 4 of the bulldozer 1 for reflecting laser beams projected from the laser light projecting/receiving device in the same direction.

In cases where the earth unloading position is situated on the edge of a cliff, arrangement may be made such that the vehicle body 2 is provided with a desired number of ultrasonic sonars at specified positions to detect the distance between each sonar and the ground that serves as a reflecting element, and the position where each sonar stops reaction may be determined as a dumping position. In a preferred embodiment, one ultrasonic sonar is provided at each front side of the vehicle body 2 such as to diagonally, forwardly project ultrasonic waves and the place where either of the ultrasonic sonars stops reaction may be determined as the edge of a cliff. In this case, the mounting angles (wave projecting angles) of these ultrasonic sonars are adjustable according to the way of dumping soil from the cliff.

Apart from the above means, it can be determined from the pattern of a change in the actual tractive force exerted on the blade 7 whether or not the earth dumping position on the edge of a cliff is reached. More precisely, this determination method was conceived from the fact that when soil falls from a cliff, the load on the blade abruptly decreases and therefore it can be judged from a change in the load whether or not the bulldozer 1 is on the edge of a cliff. It is preferable that the method using ultrasonic sonars as means for detecting an earth dumping position on a cliff and the method utilizing load change detection be employed as supplementary means for the detecting means composed of laser projectors and laser light receiving sensors. Use of a plurality of detecting means ensures more accurate detection of the edge of a cliff.

It is also possible to detect the presence of the bulldozer 1 at the earth unloading position by measuring a traveling distance from the digging start position during forward drive of the bulldozer 1 by integration of the outputs of an actual vehicle speed sensor.

For detecting that the bulldozer 1 has returned to the digging start position, arrangement may be made such that the number of revolutions of the sprockets 6 for running the crawler belts is counted starting from the earth unloading position during reverse drive of the bulldozer 1 and a reverse drive distance is obtained from the above number of revolutions.

In this embodiment, a position measurement unit utilizing laser is employed, but it is also possible to employ position measurement units of other types such as the real time kinematics method or differential method in which GPS (Global Positioning System) with the earth satellites 53 is utilized.

In this embodiment, the bulldozer 1 is automatically driven in a preset speed range selected from first to third speed ranges. However, an alternative embodiment is possible in which a maximum speed range is preset by manual operation and when automatic dozing is selected, speed is automatically varied up to the preset speed range according to detection of an actual tractive force and when automatic reverse drive is selected, speed is automatically varied up to the preset speed range according to the gradient of the ground.

Although guiding of the bull dozer 1 to a specified lane is carried out by the operator through manual operation in the embodiment, the operator may operate the bulldozer 1 from a remote place with the aid of a radio controller for various purposes, for example, guiding of the bulldozer 1 to a specified lane; determination of a digging start position and traveling direction; setting of a target tractive force, maximum speed range and the number of digging actions to be carried out; altering of lanes; and ripping operation. Use of a radio controller for operating the bulldozer 1 leads to more efficient dozing operation, because operation time per one bulldozer can be shortened and therefore one operator can supervise a plurality of bulldozers 1.

While a horizontal reaction force $F_H$ is obtained through calculation in this embodiment, it may be obtained from the amount of driving torque of the sprockets 6 detected by a driving torque sensor. Alternatively, a horizontal reaction force $F_H$ is obtained from the amount of bending stress exerted on the trunnions 10 by the straight frames 8 for supporting the blade 7, this amount being detected by a bending stress sensor. While the power transmission system includes the torque convertor unit 23 with a lock-up mechanism in this embodiment, the invention can be applied to a torque convertor without a lockup mechanism and to a direct transmission without a torque convertor. It should be understood that in the case of a direct transmission, the calculation of a horizontal reaction force $F_H$ is carried out in the same way as is in the case of "locked-up state" described before.

While the pressing force of the blade lift cylinders 11, 12 is obtained by detecting pressures on the head and bottom of each of the blade lift cylinders 11, 12 in the detection of a vertical reaction force $F_V$ in this embodiment, the pressing force may be obtained from the axial force of the blade lift cylinders 11, 12 that is detected by strain gauges attached to the cylinder rods of the blade lift cylinders 11, 12.

In this embodiment, a vertical reaction force $F_V$ is calculated by multiplying the pressing force of the blade lift cylinders 11, 12 by the cosine (cos θ) of the inclination angle θ of the yokes relative to a vertical axis, the inclination angle being detected by the yoke angle sensors. However, the value of the inclination angle θ is substantially fixed in the dozing operation, and therefore a vertical reaction force $F_V$ may be calculated with the inclination angle θ being regarded as a constant.

While the load factor of the blade 7 is calculated from the ratio between a vertical reaction force and horizontal reaction force which are exerted on the blade in this embodiment, the load factor may be obtained from a measurement of the height of earth accumulated on the front face of the blade 7, the height being detected by a pair of distance sensors (utilizing ultrasonic waves or laser beams) 52 attached to the front part of the vehicle body 2 (in this embodiment, the upper parts of the blade lift cylinders 11, 12).

Although the invention has been described with a case in which the pitch angle of the blade 7 is changed when operation is shifted from digging to carrying, the invention is applicable to a bulldozer whose pitch angle is fixed. In the case of such a bulldozer, lifting operation of the blade may be performed when operation is shifted from digging to carrying, which improves work efficiency.

The result of calculation of the ratio $F_V/F_H$ is not limited to use in informing a timing for a shift from digging to carrying and in blade control for a shift from digging to carrying. The result can be also used in informing a need for maintenance which arises when the vehicle is fatigued and in the administration of earthwork.

Although the representation of the display panel consists of pictures in this embodiment, for example a bar graph may be used to indicate the load factor of the blade.

An alternative embodiment of the invention is as follows. A digging start position and an earth unloading position are inputted to the controller 18 through the operator's teaching operation. The controllers 18 also stores a position where the operation of the blade which is controlled based on the load factor is to be shifted from digging to carrying and data on a measurement of a traveling distance from the digging start position, the traveling distance being obtained from integration of the outputs of an actual vehicle speed sensor. Based on the stored data, the automatic drive of the bulldozer 1 is performed. In this case, the automatic drive is performed in the following procedure.

(1) Digging starts at the digging start position stored in the controller.

(2) A traveling distance from the digging start position is obtained from integration of the outputs of the actual speed sensor.

(3) The stored data on the position where digging is to be switched to carrying is corrected by the present value of $F_V/F_H$ and automatic drive is changed from a digging mode to a carrying mode.

(4) When the bulldozer has come near the stored earth unloading position, unloading starts. At the earth unloading point, the transmission 24 is placed in reverse drive to start reverse driving.

(5) The number of revolutions of the sprockets (or the output rotational speed of the torque convertor or the output rotational speed of the transmission) is measured. When the bulldozer has returned to the digging start position, the transmission 24 is placed in forward drive to start forward driving. Note that the position of the blade (i.e., pitch angle) is automatically changed according to digging, carrying and earth unloading.

In this embodiment, information on changes in the load exerted on the blade 7 when operation is shifted from digging to carrying may be provided, thereby achieving more accurate control.

In the above description, data are inputted to the controller 18 through teaching by the operator, but it is also possible to input the data by specifying a digging start position and an earth unloading position on the screen of a computer.

We claim:

1. A dozing system for a bulldozer comprising:

(a) horizontal reaction force detecting means for detecting a horizontal reaction force exerted on a blade during digging operation by the blade;

(b) vertical reaction force detecting means for detecting a vertical reaction force exerted on the blade during digging operation by the blade; and (c) load factor calculating means for calculating a load factor of the blade in which earth is accumulated on its front face based on the ratio of the vertical reaction force to the horizontal reaction force, the ratio being calculated upon receipt by the load factor calculating means of outputs of the horizontal reaction force detecting means and the vertical reaction force detecting means.

2. A dozing system for a bulldozer according to claim 1, wherein the load factor calculating means calculates the load factor from a pitch angle of the blade and the ratio of the vertical reaction force to the horizontal reaction force.

3. A dozing system for a bulldozer according to claim 1 or 2, further comprising display means for displaying a value of the load factor calculated by the load factor calculating means.

4. A dozing system for a bulldozer according to claim 1 or 2, wherein the horizontal reaction force detecting means comprises an engine rotational speed sensor for detecting a rotational speed of an engine and a torque convertor output shaft revolution sensor for detecting a rotational speed of an output shaft of a torque convertor, and wherein said horizontal reaction force detecting means first calculates a speed ratio that is a ratio between the engine rotational speed detected by the engine rotational speed sensor and the torque convertor output shaft rotational speed detected by the torque convertor output shaft rotational speed sensor, then said horizontal reaction force detecting means obtains a torque convertor output torque from said speed ratio and a torque convertor characteristic of the torque convertor, and then said horizontal reaction force detecting means multiplies the torque convertor output torque by a reduction ratio between the output shaft of the torque convertor and sprockets for driving crawler belts for running a vehicle body, to thereby determine the horizontal reaction force exerted on the blade.

5. A dozing system for a bulldozer according to claim 1 or 2, wherein the horizontal reaction force detecting means comprises an engine revolution sensor for detecting a rotational speed of an engine when a torque convertor with a lock-up mechanism is locked up or a direct transmission is employed, and wherein said horizontal reaction force detecting means obtains an engine torque from the engine rotational speed detected by the engine revolution sensor and an engine torque characteristic of the engine, and wherein said horizontal reaction force detecting means multiplies the engine torque by a reduction ratio between the engine and sprockets for driving crawler belts for running a vehicle body, to thereby determine the horizontal reaction force exerted on the blades.

6. A dozing system for a bulldozer according to claim 1 or 2, wherein the horizontal reaction force detecting means comprises a bending stress sensor for detecting a bending stress exerted on trunnions that are respectively a joint of a straight frame for supporting the blade and a vehicle body, and wherein based on the bending stress detected by the bending stress sensor, the horizontal reaction force exerted on the blade is determined.

7. A dozing system for a bulldozer according to claim 1 or 2, wherein the horizontal reaction force detecting means comprises a driving torque sensor for detecting an amount of driving torque of sprockets for driving crawler belts for running a vehicle body, and wherein based on the amount of driving torque detected by the driving torque sensor, the horizontal reaction force exerted on the blade is determined.

8. A dozing system for a bulldozer comprising:

(a) horizontal reaction force detecting means for detecting a horizontal reaction force exerted on a blade during digging operation by the blade;

(b) vertical reaction force detecting means for detecting a vertical reaction force exerted on the blade during digging operation by the blade; and (c) load factor calculating means for calculating a load factor of the blade in which earth is accumulated on its front face based on the ratio of the vertical reaction force to the horizontal reaction force, the ratio being calculated upon receipt of the outputs of the horizontal reaction force detecting means and the vertical reaction force detecting means;

wherein the vertical reaction force detecting means comprises a head hydraulic pressure sensor for detecting hydraulic pressures on heads of blade lift cylinders for lifting and lowering the blade, a bottom hydraulic pressure sensor for detecting hydraulic pressures on bottoms of the blade lift cylinders, and a yoke angle sensor for detecting an inclination angle of yokes each securing one end of each blade lift cylinder, and wherein a pressing force of the blade lift cylinders is obtained from the respective hydraulic pressures detected by the head hydraulic pressure sensor and bottom hydraulic pressure sensor and the value of the pressing force is multiplied by a cosine of an inclination angle of the yokes with respect to a vertical axis, the inclination angle being detected by the yoke angle sensor, to thereby determine the vertical reaction force exerted on the blade.

9. A dozing system for a bulldozer according to claim 8, wherein the load factor calculating means calculates the load factor from the pitch angle of the blade and the ratio of the vertical reaction force to the horizontal reaction force.

10. A dozing system for a bulldozer comprising:

(a) horizontal reaction force detecting means for detecting a horizontal reaction force exerted on a blade during digging operation by the blade;

(b) vertical reaction force detecting means for detecting a vertical reaction force exerted on the blade during digging operation by the blade; and (c) load factor calculating means for calculating a load factor of the blade in which earth is accumulated on its front face based on the ratio of the vertical reaction force to the horizontal reaction force, the ratio being calculated upon receipt of the outputs of the horizontal reaction force detecting means and the vertical reaction force detecting means;

wherein the vertical reaction force detecting means comprises a head hydraulic pressure sensor for detecting hydraulic pressures on heads of blade lift cylinders for lifting and lowering the blade and a bottom hydraulic pressure sensor for detecting hydraulic pressures on bottoms of the blade lift cylinders, and wherein a pressing force of the blade lift cylinders is obtained from the respective hydraulic pressures detected by the head hydraulic pressure sensor and the bottom hydraulic pressure sensor, and a value of the pressing force is then multiplied by a constant, to thereby determine the vertical reaction force exerted on the blade.

11. A dozing system for a bulldozer according to claim 10, wherein the load factor calculating means calculates the load factor from the pitch angle of the blade and the ratio of the vertical reaction force to the horizontal reaction force.

12. A dozing system for a bulldozer comprising:

(a) horizontal reaction force detecting means for detecting a horizontal reaction force exerted on a blade during digging operation by the blade;

(b) vertical reaction force detecting means for detecting a vertical reaction force exerted on the blade during digging operation by the blade; and (c) load factor calculating means for calculating a load factor of the blade in which earth is accumulated on its front face based on the ratio of the vertical reaction force to the horizontal reaction force, the ratio being calculated upon receipt of the outputs of the horizontal reaction force detecting means and the vertical reaction force detecting means;

wherein the vertical reaction force detecting means comprises strain gauges attached to cylinder rods of blade lift cylinders for lifting and lowering the blade and a yoke angle sensor for detecting an inclination angle of yokes each securing one end of each blade lift cylinder, and wherein a pressing force of the blade lift cylinders is obtained from an axial force of the blade lift cylinders detected by the strain gauges, and the pressing force is multiplied by a cosine of the inclination angle of the yokes with respect to a vertical axis detected by the yoke angle sensor, to thereby determine the vertical reaction force exerted on the blade.

13. A dozing system for a bulldozer according to claim 12, wherein the load factor calculating means calculates the load factor from the pitch angle of the blade and the ratio of the vertical reaction force to the horizontal reaction force.

14. A dozing system for a bulldozer comprising:

(a) horizontal reaction force detecting means for detecting a horizontal reaction force exerted on a blade during digging operation by the blade;

(b) vertical reaction force detecting means for detecting a vertical reaction force exerted on the blade during digging operation by the blade; and (c) load factor calculating means for calculating a load factor of the blade in which earth is accumulated on its front face based on the ratio of the vertical reaction force to the horizontal reaction force, the ratio being calculated upon receipt of the outputs of the horizontal reaction force detecting means and the vertical reaction force detecting means;

wherein the vertical reaction force detecting means comprises strain gauges attached to cylinder rods of blade lift cylinders for lifting and lowering the blade, and wherein a pressing force of the blade lift cylinders is obtained from an axial force of the blade lift cylinders detected by the strain gauges, and the pressing force is multiplied by a constant to thereby determine the vertical reaction force exerted on the blade.

15. A dozing system for a bulldozer according to claim 14, wherein the load factor calculating means calculates the load factor from the pitch angle of the blade and the ratio of the vertical reaction force to the horizontal reaction force.

16. A dozing system for a bulldozer comprising:

(a) load factor calculating means for calculating a load factor of a blade in which earth is accumulated on a front face of the blade during a digging operation by the blade; and (b) blade controlling means for controlling the blade so as to incline backwardly to hold earth, when the load factor calculated by the load factor calculating means reaches a specified value, wherein the load factor calculating means detects a horizontal reaction force and a vertical reaction force exerted on the blade, calculates the ratio of the vertical reaction force to the horizontal reaction force, and calculates the load factor from said ratio and a pitch angle of the blade.

17. A dozing system for a bulldozer according to claim 16, which further comprises unloading position detecting means for detecting that the bulldozer has reached an earth unloading position, and wherein the blade controlling means controls the blade such that the blade inclines forwardly to unload earth, carried by the blade, in response to an output of the unloading position detecting means.

18. A dozing system for a bulldozer according to claim 17, which further comprises transmission controlling means for controlling a transmission so as to place the transmission in reverse drive when the unloading position detecting means detects that the bulldozer has reached the earth unloading position.

19. A dozing system for a bulldozer according to claim 17 or 18, wherein the unloading position detecting means comprises at least one laser projector disposed on the ground and a light receiving sensor disposed on the bulldozer for receiving laser beams projected from the laser projector.

20. A dozing system for a bulldozer according to claim 17 or 18, wherein the unloading position detecting means comprises at least one laser projecting and receiving device disposed on the ground and a reflector disposed on the bulldozer for reflecting laser beams projected from the laser projecting and receiving device in the same direction.

21. A dozing system for a bulldozer according to claim 17 or 18, wherein the unloading position detecting means comprises an ultrasonic sonar disposed on the bulldozer for projecting ultrasonic waves ahead of a vehicle body to detect the presence of the ground.

22. A dozing system for a bulldozer according to claim 17 or 18, wherein the unloading position detecting means comprises a load detector for estimating an amount of earth ahead of the blade from changes in a load exerted on the blade.

23. A dozing system for a bulldozer according to claim 17 or 18, wherein the unloading position detecting means detects the earth unloading position by measuring a travel distance of a bulldozer from a digging start position during forward drive by integration of outputs of an actual vehicle speed sensor.

24. A dozing system for a bulldozer according to claim 17 or 18, wherein the unloading position detecting means detects the earth unloading position by Global Positioning System.

25. A dozing system for a bulldozer according to claim 18, which further comprises digging start position detecting means for detecting that the bulldozer has reached a digging start position, and wherein the transmission controlling means controls the transmission so as to place the transmission in forward drive in response to an output of the digging start position detecting means.

26. A dozing system for a bulldozer according to claim 25, wherein the digging start position detecting means comprises at least one laser projector disposed on the ground and a light receiving sensor disposed on the bulldozer for receiving laser beams projected from said at least one laser projector.

27. A dozing system for a bulldozer according to claim 25, wherein the digging start position detecting means comprises at least one laser projecting and receiving device disposed on the ground and a reflector disposed on the bulldozer for reflecting laser beams projected from the laser projecting and receiving device in the same direction.

28. A dozing system for a bulldozer according to claim 25, wherein the digging start position detecting means detects the digging start position by counting a number of revolutions of sprockets for driving crawler belts, starting from the earth unloading position during reverse drive of the bulldozer.

29. A dozing system for a bulldozer according to claim 25, wherein the digging start position detecting means detects the digging start position by Global Positioning System.

30. A dozing system for a bulldozer in accordance with claim 16, further comprising a bulldozer body, left and right frame members, a first end of each of said frame members being pivotally connected to said bulldozer body and a second end of each of said frame members being pivotally connected to a respective end portion of the blade;

wherein said blade controlling means comprises a pair of pitch cylinders, each pitch cylinder being connected between a respective end portion of the blade and a respective one of said left and right frame members, for inclining both end portions of said blade backwardly from a digging position of the blade to a carrying position of the blade.

31. A dozing system for a bulldozer comprising:

(a) load factor calculating means for calculating a load factor of a blade in which earth is accumulated on a front face of the blade during a digging operation by the blade; and (b) blade controlling means for controlling the blade so as to incline backwardly to hold earth, when the load factor calculated by the load factor calculating means reaches a specified value, and (c) target pitch angle calculating means for calculating a target pitch angle, used for inclining the blade backwardly, from the load factor calculated by the load factor calculating means and a pitch angle of the blade, wherein the load factor calculating means detects a horizontal reaction force and a vertical reaction force exerted on the blade, calculates the ratio of the vertical reaction force to the horizontal reaction force, and calculates the load factor from said ratio and a pitch angle of the blade, and wherein the blade controlling means controls the blade such that the pitch angle of the blade becomes equal to the target pitch angle calculated by the target pitch angle calculating means.

32. A dozing system for a bulldozer comprising:

(a) load factor calculating means for calculating a load factor of a blade in which earth is accumulated on a front face of the blade during a digging operation by the blade;

(b) blade controlling means for controlling the blade so as to incline backwardly to hold earth, when the load factor calculated by the load factor calculating means reaches a specified value;

(c) memory means for storing a digging start position, and an earth unloading position which are inputted by teaching by an operator and storing a digging/carrying switch position where the blade is inclined backwardly by the blade controlling means; and (d) drive controlling means for performing control according to an output signal from the memory means such that when the bulldozer is found to be in the digging start position, a transmission is placed in forward drive; when the bulldozer is found to be in the earth unloading position, the blade is caused to forwardly incline thereby unloading carried earth and the transmission is placed in reverse drive; and when the bulldozer is found to be in the digging/carrying switch position, the blade is allowed to backwardly incline to hold the earth, wherein the load factor calculating means detects a horizontal reaction force and a vertical reaction force exerted on the blade, calculates the ratio of the vertical reaction force to the horizontal reaction force, and calculates the load factor from said ratio and a pitch angle of the blade.

33. A dozing system for a bulldozer comprising:

(a) load factor calculating means for calculating a load factor of a blade in which earth is accumulated on a front face of the blade during a digging operation by the blade;

(b) blade controlling means for controlling the blade so as to incline backwardly to hold earth, when the load factor calculated by the load factor calculating means reaches a specified value; and (c) target pitch angle calculating means for calculating a target pitch angle, used for inclining the blade backwardly, from the load factor calculated by the load factor calculating means and a pitch angle of the blade, wherein the load factor calculating means obtains the load factor by measuring a height of earth accumulated on the front face of the blade with a distance sensor attached to a vehicle body of the bulldozer, and wherein the blade controlling means controls the blade such that the pitch angle of the blade becomes equal to the target pitch angle calculated by the target pitch angle calculating means.

34. A dozing system for a bulldozer comprising:

(a) load factor calculating means for calculating a load factor of a blade in which earth is accumulated on a front face of the blade during a digging operation by the blade;

(b) blade controlling means for controlling the blade so as to incline backwardly to hold earth, when the load factor calculated by the load factor calculating means reaches a specified value;

(c) memory means for storing a digging start position, and an earth unloading position which are inputted by teaching by an operator and storing a digging/carrying switch position where the blade is inclined backwardly by the blade controlling means; and (d) drive controlling means for performing control according to an output signal from the memory means such that when the bulldozer is found to be in the digging start position, a transmission is placed in forward drive; when the bulldozer is found to be in the earth unloading position, the blade is caused to forwardly incline thereby unloading carried earth and the transmission is placed in reverse drive; and when the bulldozer is found to be in the digging/carrying switch position, the blade is allowed to backwardly incline to hold the earth, wherein the load factor calculating means obtains the load factor by measuring a height of earth accumulated on the front face of the blade with a distance sensor attached to a vehicle body of the bulldozer.

* * * * *